US009354533B2

(12) United States Patent
Takahashi et al.

(10) Patent No.: US 9,354,533 B2
(45) **Date of Patent: *May 31, 2016**

(54) ELECTROPHOTOGRAPHIC TONER, TWO-COMPONENT DEVELOPER CONTAINING TONER, AND IMAGE FORMING APPARATUS

(71) Applicant: RICOH COMPANY, LTD., Tokyo (JP)

(72) Inventors: Rintaro Takahashi, Kanagawa (JP); Kazumi Suzuki, Shizuoka (JP); Masana Shiba, Shizuoka (JP); Tatsuya Morita, Kanagawa (JP); Yoshitaka Yamauchi, Shizuoka (JP); Azumi Miyaake, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 34 days.

This patent is subject to a terminal disclaimer.

(21) Appl. No.: 14/029,009

(22) Filed: Sep. 17, 2013

(65) Prior Publication Data

US 2014/0080047 A1 Mar. 20, 2014

(30) Foreign Application Priority Data

Sep. 18, 2012 (JP) ..... 2012-203850
Feb. 1, 2013 (JP) ..... 2013-018152

(51) Int. Cl.
*G03G 9/087* (2006.01)
*G03G 9/08* (2006.01)

(52) U.S. Cl.
CPC ..... *G03G 9/0821* (2013.01); *G03G 9/0804* (2013.01); *G03G 9/08755* (2013.01); *G03G 9/08764* (2013.01); *G03G 9/08795* (2013.01); *G03G 9/08797* (2013.01)

(58) Field of Classification Search
CPC ..... G03G 9/08755; G03G 9/08797; G03G 9/08795
USPC ..... 430/109.4
See application file for complete search history.

(56) References Cited

U.S. PATENT DOCUMENTS

| | | | | |
|---|---|---|---|---|
| 8,808,955 | B2 * | 8/2014 | Nakayama et al. | 430/109.4 |
| 8,852,834 | B2 * | 10/2014 | Santo et al. | 430/108.1 |
| 2001/0046636 | A1 | 11/2001 | Daimon et al. | |
| 2006/0204880 | A1 | 9/2006 | Mizutani et al. | |
| 2012/0107741 | A1 * | 5/2012 | Hiraoka et al. | 430/137.12 |

(Continued)

FOREIGN PATENT DOCUMENTS

| | | |
|---|---|---|
| JP | 04-024702 | 4/1992 |
| JP | 04-024703 | 4/1992 |

(Continued)

*Primary Examiner* — Hoa V Le
(74) *Attorney, Agent, or Firm* — Oblon, McClelland, Maier & Neustadt, L.L.P.

(57) ABSTRACT

To provide an electrophotographic toner, which contains a crystalline resin, a non-crystalline resin, a colorant, and a releasing agent, wherein the toner has a storage elastic modulus of $5.0\times10^4$ Pa to $5.0\times10^6$ Pa at 80° C., and a storage elastic modulus of $2.0\times10^2$ Pa to $2.0\times10^3$ Pa at 140° C., and wherein the toner has a ratio (C)/((C)+(A)) of 0.10 or greater, where (C) is an integrated intensity of a diffraction spectrum derived from a crystalline structure, (A) is an integrated intensity of a diffraction spectrum derived from a non-crystalline structure, and the diffraction spectrum is a diffraction spectrum of the toner as measured by an X-ray diffraction spectrometer.

17 Claims, 4 Drawing Sheets

(56) References Cited

U.S. PATENT DOCUMENTS

| | | | | |
|---|---|---|---|---|
| 2012/0122027 | A1* | 5/2012 | Watanabe et al. | 430/108.4 |
| 2012/0189951 | A1* | 7/2012 | Sugimoto et al. | 430/108.2 |
| 2012/0214095 | A1* | 8/2012 | Shu et al. | 430/105 |
| 2012/0231387 | A1* | 9/2012 | Sugiura | 430/108.4 |
| 2013/0059247 | A1* | 3/2013 | Sugimoto et al. | 430/109.4 |
| 2013/0078563 | A1 | 3/2013 | Nakayama et al. | |
| 2013/0157184 | A1 | 6/2013 | Sugimoto et al. | |
| 2013/0157193 | A1* | 6/2013 | Moritani et al. | 430/109.4 |
| 2013/0164668 | A1* | 6/2013 | Sacripante et al. | 430/108.1 |
| 2013/0171554 | A1 | 7/2013 | Yamashita et al. | |
| 2013/0196258 | A1* | 8/2013 | Inaba et al. | 430/105 |
| 2013/0196263 | A1 | 8/2013 | Asahina et al. | |

FOREIGN PATENT DOCUMENTS

| | | |
|---|---|---|
| JP | 3360527 | 10/2002 |
| JP | 3910338 | 2/2007 |
| JP | 2007-086502 | 4/2007 |
| JP | 3949526 | 4/2007 |
| JP | 2010-077419 | 4/2010 |
| JP | 4513627 | 5/2010 |
| JP | 4729950 | 4/2011 |

* cited by examiner

ELECTROPHOTOGRAPHIC TONER, TWO-COMPONENT DEVELOPER CONTAINING TONER, AND IMAGE FORMING APPARATUS

BACKGROUND OF THE INVENTION

1. Field of the Invention

The present invention relates to an electrophotographic toner, a two-component developer containing the toner, and an image forming apparatus.

2. Description of the Related Art

Conventionally, a latent image formed electrically or magnetically in an electrophotographic image forming apparatus is visualized with an electrophotographic toner (may referred to merely as a "toner" hereinafter). In the electrophotography, for example, an electrostatic image (a latent image) is formed on a photoconductor, followed by developing the latent image with a toner, to thereby form a toner image. The toner image is generally transferred to a transfer medium, such as paper, followed by fixed on the transfer medium. In the process of fixing the toner image on the transfer paper, a thermal fixing system, such as a heat roller fixing system, and a heat belt fixing system, is widely used because of its energy efficiency.

Recently, in the market, there is an increasing need for increased printing speed and energy saving of image forming apparatuses. To this end, desired is a toner having excellent low temperature fixing ability, and capable of providing high quality images. To achieve low temperature fixing ability of a toner, a softening point of a binder resin used in the toner needs to be set low. When the softening point of the binder resin is low, however, part of a toner image tends to be deposited on a surface of a fixing member during fixing, which will then be transferred to a photocopy sheet, which is so-called offset (may be referred to as "hot offset" hereinafter). Moreover, heat resistant storage stability of a toner reduces, and blocking, which is a phenomenon that toner particles are fused to each other especially in high temperature environment, tends to occur. In addition, there is a problem that a toner is fused on an internal area of a developing unit or a regulating member of the developing unit to pollute inside the developing unit, and a problem that toner filming is caused on a photoconductor.

As a technique to solve these problems, it has been known that a crystalline resin is used as a binder resin of a toner. Specifically, the crystalline resin sharply softens at a melting point of the resin, and therefore a softening point of the toner can be reduced to adjacent to the melting point while securing heat resistant storage stability at temperature equal to or lower than the melting point. Therefore, the low temperature fixing ability and heat resistant storage stability are both achieved.

As a toner using a crystalline resin, for example, disclosed is a toner using, as a binder resin, a crystalline resin obtained through a chain elongation of crystalline polyester with diisocyanate (see Japanese Patent Publication Application (JP-B) Nos. 04-024702 and 04-024703). These disclosed toners have excellent low temperature fixing ability, but insufficient hot offset resistance, and therefore do not reach the quality required in the recent market.

Moreover, disclosed is a toner using a crystalline resin having a crosslink structure formed by an unsaturated bond containing a sulfonic acid group (see Japanese Patent (JP-B) No. 3910338). This toner can improve hot offset resistance compared to toners in the conventional art. Further, disclosed is a technique associated resin particles having excellent low temperature fixing ability and heat resistant storage stability in which a ratio of softening point and melt heat peak temperature, and viscoelastic property are specified (see Japanese Application Laid-Open (JP-A) No. 2010-077419).

These toners using a crystalline resin as a main component of a binder resin have excellent impact resistance due to the properties of the resin, but have weak impression hardness, such as Vickers hardness. Therefore, there are problems that pollution to a regulating member or inside a developing unit is caused due to stirring stress within the developing unit, filming is caused on a, photoconductor, and charging ability or flowability of the toner tends to be impaired due to embedded external additive to toner particles. Moreover, it takes a long time for the toner melted on a fixing medium (transfer medium) during thermal fixing to recrystallize, and therefore hardness of a surface of an image cannot be promptly recovered. As a result, there are problems that variations in glossiness due to a roller mark formed on the surface of the image or damage are caused by a discharge roller in discharging after fixing. Moreover, the hardness is not sufficient even after the hardness of the surface of the image is recovered by recrystallization of the toner, a resulting image does not have sufficient resistance to scratches or abrasion.

Meanwhile, disclosed is a technique for improving stress resistance of a toner by specifying duro meter hardness of a crystalline resin, and adding inorganic particles in the toner (see JP-B No. 3360527).

However, such toner cannot improve damages of a roller mark just after fixing, and image hardness after recrystallization is also insufficient. Moreover, the inorganic particles significantly adversely affect low temperature fixing ability of the toner, and therefore an advantage of the crystalline resin to the fixing ability cannot be utilized at the maximum level.

Meanwhile, disclosed are various techniques in which a crystalline resin and a non-crystalline resin are used in combination, unlike the aforementioned conventional art using only a crystalline resin as a main component of a binder resin (see, for example, JP-B Nos. 3949526 and 4513627).

These disclosed techniques achieve low temperature fixing ability of a toner, as crystalline polyester sharply melts compared to a non-crystalline polyester. However, the non-crystalline polyester remains unmelted, when the crystalline polyester is melted. Fixing cannot be performed unless both the crystalline polyester and the non-crystalline polyester are melted to a certain degree. Accordingly, these techniques do not achieve a high level of low temperature fixing ability to meet the recent demands.

SUMMARY OF THE INVENTION

The present invention aims to solve the aforementioned problems in the art, and achieve the following object. An object of the present invention is to provide an electrophotographic toner, which contains at least two type of binder resins, and can achieve both low temperature fixing ability and heat resistant storage stability at high levels.

The aforementioned object can be achieved with the following toner of the present invention.

An electrophotographic toner, containing:

a crystalline resin;

a non-crystalline resin;

a colorant; and a releasing agent, wherein the toner has a storage elastic modulus of $5.0\times10^4$ Pa to $5.0\times10^6$ Pa at 80° C., and a storage elastic modulus of $2.0\times10^2$ Pa to $2.0\times10^3$ Pa at 140° C., and wherein the toner has a ratio (C)/((C)+(A)) of 0.10 or greater, where (C) is an integrated intensity of a diffraction spectrum derived from a crystalline structure, (A) is an integrated intensity of a diffraction spectrum derived from a non-crystalline structure, and the diffraction spectrum is a diffraction spectrum of the toner as measured by an X-ray diffraction spectrometer.

The present invention can solve the aforementioned various problems in the art, and can provide an electrophotographic toner, which can achieve both low temperature fixing ability and heat resistant storage stability at high levels

DETAILED DESCRIPTION OF THE INVENTION

<Binder Resin>

Figure 1A:
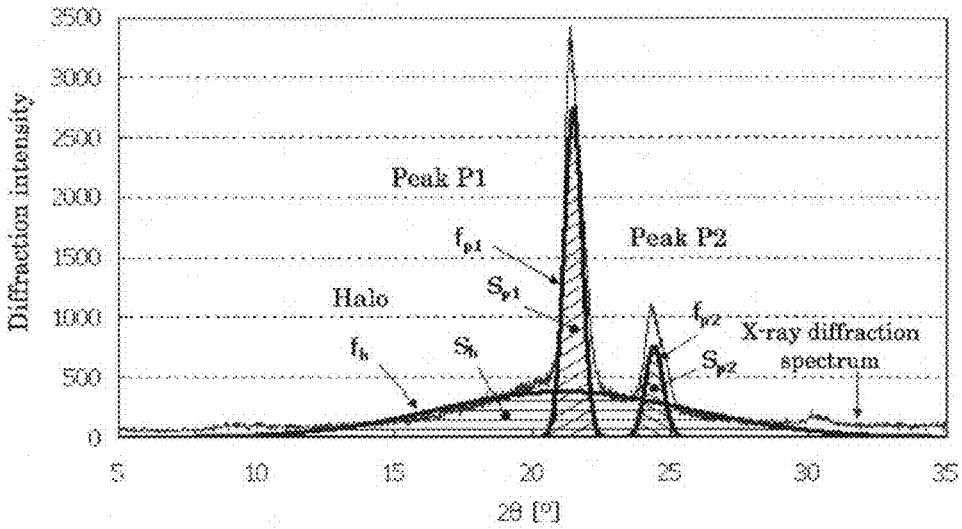
FIG. 1A is a diagram illustrating one example of a graph for the crystalline degree calculation of the toner of the present invention after fitting.

The electrophotographic toner of the present invention contains at least two resins, a crystalline resin, and a non-crystalline resin. The glass transition temperature of the non-crystalline resin, as measured by a differential scanning calorimeter (DSC) is preferably −60° C. or higher, but lower than 0° C. in view of heat resistant storage stability and low temperature fixing ability.

The non-crystalline resin having very low glass transition temperature has characteristics that it deforms at low temperature, and deforms with heat and pressure applied during fixing, thus easily adhering to paper at lower temperature. Especially in the case where a urethane bond or urea bond having high aggregation energy is contained, a resulting toner has excellent adhesion to paper. When the toner has a branch structure in a molecular skeleton thereof, moreover, the urethane bond segment or urea bond segment having high aggregation energy acts as an apparent crosslinking point. Therefore, a molecular chain thereof forms a three-dimensional network structure. As a result, the toner has rubber-like characteristics that it deforms at low temperature but does not flow. Accordingly, the toner can secure both heat resistant storage stability, and hot offset resistance.

The non-crystalline resin has its glass transition temperature in the very low temperature region. In the case where an amount of the non-crystalline resin is 50% by mass or greater relative to the entire toner, therefore, the low temperature fixing ability of the toner can be improved as the melting point of the toner as a whole lowers, but the heat resistant storage stability may be impaired. In view of this point, the crystalline resin preferably occupies 50% by mass or greater of the binder resin.

Moreover, the ratio is 0.10 or greater, preferably 0.15 or greater, more preferably 0.20 or greater, even more preferably 0.30 or greater, and particularly preferably 0.45 or greater in view of both fixing ability and heat resistant storage stability, where (C) is an integrated intensity of a spectrum derived from a crystalline structure, and (A) is an integrated intensity of a spectrum derived from a non-crystal structure, where the spectrum is a diffraction spectrum of the toner obtained by an X-ray diffractometer.

The ratio (C)/((C)+(A)) is an index for an amount of the crystalline segment in the binder resin, which is a main component of the toner, and an area ratio of a min diffraction peak derived from a crystal structure to halo in the diffraction spectrum obtained by X-ray diffraction spectroscopy. In the present invention, X-ray diffraction spectroscopy is performed by means of an X-ray diffractometer equipped with a 2D detector (D8 DISCOVER with GADDS, of Bruker Japan).

As for a capillary tube for use in the measurement, a marked tube (Lindemann glass) having a diameter of 0.70 mm is used. A sample is loaded in the capillary tube up to the top of the capillary tube to carry out the measurement. At the time when the sample is loaded, tapping is performed, and a number of taps is 100 times. Specific conditions for the measurement are as follows:

Tube current: 40 mA
Tube voltage: 40 kV
Goniometer 2θ axis: 20.0000°
Goniometer Ω axis: 0.0000°
Goniometer ϕ axis: 0.0000°
Detector distance: 15 cm (wide angle measurement)
Measuring range: 3.2≤2θ(°)≤37.2
Measuring time: 600 sec As for an incident optical system, a collimator having a pin hole having a diameter of 1 mm is used. The obtained 2D data was integrated using the supplied software (x axis: 3.2° to 37.2°) to invert the 2D data into 1D data of diffraction intensity and 20.

Figure 1B:
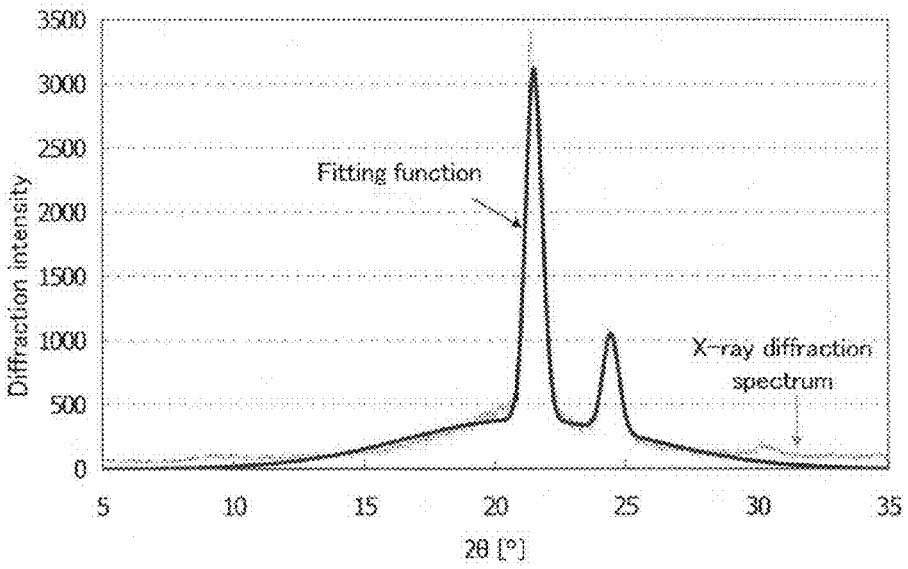
FIG. 1B is a diagram illustrating one example of a graph for the crystalline degree calculation of the toner of the present invention after fitting.

A method for calculating the ratio (C)/((C)+(A)) based on the results obtained from the X-ray diffraction spectroscopy will be explained hereinafter. Examples of the diffraction spectrums obtained by X-ray diffraction spectroscopy are presented in FIGS. 1A and 1B. The horizontal axis represents 2θ, the longitudinal axis represents X-ray diffraction intensity, and both are linear axes. In the X-ray diffraction spectrum of FIG. 1A, the main peaks (P1, P2) are appeared at 2θ=21.3°, 24.2°, and the halo (h) is appeared in the wide range including these two peaks. The main peaks are derived from a crystalline structure, and the halo is derived from the non-crystalline structure. The two main peaks, and halo are respectively represented with Gaussian functions of the following formulae A(1) to A(3).

$$f_{p1}(2\theta)=a_{p1}\exp\{-(2\theta-b_{p1})^2/(2c_{p1}^2)\} \quad \text{Formula A(1)}$$

$$f_{p2}(2\theta)=a_{p2}\exp\{-(2\theta-b_{p2})^2/(2c_{p2}^2)\} \quad \text{Formula A(2)}$$

$$f_h(2\theta)=a_h\exp\{-(2\theta-b_h)^2/(2c_h^2)\} \quad \text{Formula A(3)}$$

(In the formulae above, $f_{p1}(2\theta)$, $f_{p2}(2\theta)$, $f_h(2\theta)$ are functions corresponding to the main peaks P1, P2, and halo, respectively.)

Then, the following formula A(4) represented as a sum of these three functions is used as a fitting function (depicted in FIG. 1B) of the entire X-ray diffraction spectrum.

$$f(2\theta)=f_{p1}(2\theta)+f_{p2}(2\theta)+f_h(2\theta) \quad \text{Formula A(4)}$$

The fitting is performed by the least-squares method.

The variables for the fitting are 9 variables, i.e., $a_{p1}$, $b_{p1}$, $c_{p1}$, $a_{p2}$, $b_{p2}$, $c_{p2}$, $a_h$, $b_h$, and $c_h$. As for a fitting initial value of each variable, peak positions of X-ray diffraction ($b_{p1}$=21.3, $b_{p2}$=24.2, $b_h$=22.5 in the example depicted in FIG. 1A) are set for $b_{p1}$, $b_{p2}$, and $b_h$, and for other variables, values are appropriately assigned, and the values with which the two main peaks and halo are matched to the X-ray diffraction spectrum as close as possible are set as the fitting initial values of the aforementioned other variables. The fitting can be performed, for example, using a solver, Excel 2003, of Microsoft Corporation.

The ratio (C)/((C)+(A)), which is an index for an amount of the crystalline segments, can be calculated from the integrated areas ($S_{P1}$, $S_{p2}$, $S_h$) of Gaussian functions $f_{p1}(2\theta)$, $f_{p2}(2\theta)$, which are corresponded to the two main peaks after the fitting (P1, P2), and Gaussian function $f_h(2\theta)$, which is corresponded to the halo, where ($S_{p1}$+$S_{p2}$) is determined as (C), and ($S_h$) is determined as (A).

In the present invention, the "crystalline resin" is a resin satisfying a ratio (softening temperature [° C.]/maximum peak temperature of heat of melting [° C.]) of 0.80 to 1.55, where the ratio is a ratio of the softening temperature measured by an elevated flow tester to the maximum peak temperature of heat of melting measured by a differential scanning calorimeter (DSC). The "crystalline resin" has a characteristic that it sharply softens with heat.

In the present invention, moreover, a resin satisfying a ratio (softening temperature [° C.]/maximum peak temperature of heat of melting [° C.]) of greater than 1.55 is defined as a "non-crystalline resin," where the ratio is a ratio of the softening temperature to the maximum peak temperature of heat of melting. The "non-crystalline resin" has a characteristic that it gradually softens with heat.

Note that the presence of the crystalline resin in the toner can be confirmed by applying the aforementioned method to the resin extracted from the toner.

Note that, the softening points of the crystalline resin and the toner can be measured by an elevated flow tester (e.g., CFT-500D manufactured by Shimadzu Corporation). As a sample, 1 g of a resin or a toner is used. The sample is heated at the heating rate of 6° C./min, and at the same time, load of 1.96 Mpa is applied by a plunger to extrude the sample from a nozzle having a diameter of 1 mm and length of 1 mm, during which an amount of the plunger of the flow tester pushed down relative to the temperature is plotted. The temperature at which half of the sample is flown out is determined as a softening point of the sample.

The maximum peak temperatures of heat of melting the binder resin and toner can be measured by a differential scanning calorimeter (DSC) (e.g., TA-60WS and DSC-60 of Shimadzu Corporation).

Specifically, the sample is melted at 130° C., followed by cooled from 130° C. to 70° C. at the rate of 1.0° C./min. Next, the sample was cooled from 70° C. to 10° C. at the rate of 0.5° C./min. Then, the sample is heated at the heating rate of 20° C./min to measure the endothermic and exothermic changes by DSC, to thereby plot "absorption or evolution heat capacity" verses "temperature" in a graph. In the graph, the endothermic peak temperature appeared in the temperature range from 20° C. to 100° C. is determined as an endothermic peak temperature, Ta*. In the case where there are a few endothermic peaks within the aforementioned temperature range, the temperature of the peak at which the absorption heat capacity is the largest is determined as Ta*. Thereafter, the sample is stored for 6 hours at the temperature that is (Ta*−10)° C., followed by storing for 6 hours at the temperature that is (Ta*−15)° C. Next, the sample is cooled to 0° C. at the cooling rate of 10° C./min, and then heated at the heating rate of 20° C./min to measure the endothermic and exothermic changes by means of DSC, creating a graph in the same manner as the above. In the graph, the temperature corresponding to the maximum peak of the absorption or evolution heat capacity is determined as the maximum peak temperature of heat of melting.

<<Crystalline Resin>>

The crystalline resin is appropriately selected depending on the intended purpose without any limitation, provided that it has crystallinity. Examples thereof include a polyester resin, a polyurethane resin, a polyurea resin, a polyamide resin, a polyether resin, a vinyl resin, and a modified crystalline resin. These may be used alone, or in combination. Among them, preferred are a polyester resin, a polyurethane resin, a polyurea resin, a polyamide resin, and a polyether resin, and the crystalline resin is preferably a resin having at least a urethane skeleton, or a urea skeleton, or both thereof. Moreover, a straight chain polyester resin, and a composite resin containing the straight chain polyester resin are preferable.

Preferable examples of the resin having at least a urethane skeleton, or a urea skeleton, or both thereof include a polyurethane resin, a polyurea resin, a urethane-modified polyester resin, and a urea-modified polyester resin.

The urethane-modified polyester resin is a resin obtained by allowing a polyester resin having an isocyanate group at a terminal thereof to react with polyol. Moreover, the urea-modified polyester resin is a resin obtained by allowing a polyester resin having an isocyanate group at a terminal thereof to react with amine.

In the toner of the present invention, the crystalline resin and the non-crystalline resin are compatible to each other. In order to make the crystalline resin and the non-crystalline resin compatible to each other, it is preferred that the crystalline resin be a crystalline polyester resin and the non-crystalline resin described later be a non-crystalline polyester resin.

The maximum peak temperature of heat of melting the crystalline resin is preferably 45° C. to 70° C., more preferably 53° C. to 65° C., and even more preferably 58° C. to 62° C. for attaining both low temperature fixing ability and heat resistant storage stability of the resulting toner. When the maximum peak temperature thereof is lower than 45° C., the resulting toner has desirable low temperature fixing ability, but insufficient heat resistant storage stability. When the maximum peak temperature thereof is higher than 70° C., the toner has desirable heat resistant storage stability, but insufficient low temperature fixing ability.

The crystalline resin has a ratio (softening point/maximum peak temperature of heat of melting) of 0.80 to 1.55, preferably 0.85 to 1.25, more preferably 0.90 to 1.20, and even more preferably 0.90 to 1.19, where the ratio is a ratio of a softening point of the crystalline resin to a maximum peak temperature of heat of melting the crystalline resin. The smaller value of the ratio is preferable as the smaller the value is more sharply the resin is softened, which can realize to achieve both low temperature fixing ability and heat resistant storage stability of the resulting toner.

Regarding the viscoelastic properties of the crystalline resin, storage elastic modulus G' of the crystalline resin at the temperature that is the maximum peak temperature of heat of melting+20° C. is preferably $5.0\times10^6$ Pa or lower, more preferably $1.0\times10^1$ Pa to $5.0\times10^5$ Pa, and even more preferably $1.0\times10^1$ Pa to $1.0\times10^4$ Pa.

Moreover, loss elastic modulus G" of the crystalline resin at the temperature that is the maximum peak temperature of heat of melting+20° C. is preferably $5.0\times10^6$ Pa or lower, more preferably $1.0\times10^1$ Pa to $5.0\times10^5$ Pa, and even more preferably $1.0\times10^1$ Pa to $1.0\times10^4$ Pa.

As for the viscoelastic properties of the toner of the present invention, the values of G' and G" at the temperature the maximum peak temperature of heat of melting+20° C. falling into the range of $1.0\times10^3$ Pa·s to $5.0\times10^6$ Pa is preferable for giving the fixing strength and hot offset resistance to the resulting toner. Considering that the values of G' and G" increase as the colorant or layered inorganic mineral is dispersed in the binder resin, the viscoelastic properties of the crystalline resin are preferably within the aforementioned range.

The aforementioned viscoelastic properties of the crystalline resin can be achieved by adjusting a mixing ratio between a crystalline monomer and non-crystalline monomer constituting the binder resin, or the molecular weight of the binder resin. For example, the value of G' (Ta+20) degreases as a proportion of the crystalline monomer increases in the monomers constituting the binder resin.

Dynamic viscoelastic values (storage elastic modulus G', loss elastic modulus G") of the resin and toner can be measured by means of a dynamic viscoelastometer (e.g., ARES of TA Instruments Japan Inc.). The measurement is carried out with a frequency of 1 Hz. A sample is formed into a pellet having a diameter of 8 mm, and a thickness of 1 mm to 2 mm, and the pellet sample is fixed to a parallel plate having a diameter of 8 mm, followed by stabilizing at 40° C. Then, the sample is heated to 200° C. at the heating rate of 2.0° C./min with frequency of 1 Hz (6.28 rad/s), and strain of 0.1% (in a strain control mode) to thereby measure dynamic viscoelastic values of the sample.

In view of fixing ability of a resulting toner, the weight average molecular weight (Mw) of the crystalline resin is preferably 2,000 to 100,000, more preferably 5,000 to 60,000, and even more preferably 8,000 to 30,000. When the weight average molecular weight thereof is smaller than 2,000, hot offset resistance of the resulting toner may be impaired. When the weight average molecular weight thereof is greater than 100,000, low temperature fixing ability of the resulting toner may be impaired.

In the present invention, the weight average molecular weight (Mw) of the binder resin can be measured by means of a gel permeation chromatography (GPC) measuring device (e.g., GPC-8220GPC of Tosoh Corporation). As for a column used for the measurement, TSKgel Super HZM-H, 15 cm, three connected columns (of Tosoh Corporation) are used. The resin to be measured is formed into a 0.15% by mass solution using tetrahydrofuran (THF) (containing a stabilizer, manufactured by Wako Chemical Industries, Ltd.), and the resulting solution is subjected to filtration using a filter having a pore size of 0.2 μM, from which the filtrate is provided as a sample. The THF sample solution is injected in an amount of 100 μL into the measuring device, and the measurement is carried out at a flow rate of 0.35 mL/min in the environment having the temperature of 40° C. For the measurement of the molecular weight distribution of the sample, a molecular weight distribution of the sample is calculated from the relationship between the logarithmic value of the calibration curve prepared from a several monodispersible polystyrene standard samples and the number of counts. As the standard polystyrene samples for preparing the calibration curve, Showdex STANDARD Std. Nos. S-7300, S-210, S-390, S-875, S-1980, S-10.9, S-629, S-3.0, and S-0.580 of SHOWA DENKO K.K., and toluene are used. As the detector, a refractive index (RI) detector is used.

<<<Polyester Resin>>>

Examples of the polyester resin as the crystalline resin include a polycondensate polyester resin synthesized from polyol and polycarboxylic acid, a lactone ring-opening polymerization product, and polyhydroxy carboxylic acid. Among them, a polycondensate polyester resin synthesized from diol and dicarboxylic acid is preferable in view of exhibition of crystallinity.

—Polyol—

Examples of the polyol include diol, and trivalent to octavalent or higher polyol.

The diol is appropriately selected depending on the intended purpose without any limitation, and examples thereof include: aliphatic diol, such as straight chain aliphatic diol, and branched aliphatic diol having 2 to 36 carbon atoms in the branch chain thereof; C4-C36 alkylene ether glycol; C4-C36 alicyclic diol; an alkylene oxide (may be abbreviated as AO, hereinafter) adduct of the aforementioned alicyclic diol; an AO adduct of bisphenol; polylactone diol; polybutadiene diol; and diol containing a carboxyl group, diol having a sulfonic acid group or a sulfamic acid, and diol having another functional group, such as a salt of any of the aforementioned acids. Among them, an aliphatic diol whose chain has 2 to 36 carbon atoms is preferable, and straight chain aliphatic diol is more preferable. These may be used alone, or in combination.

An amount of the straight chain aliphatic diol in the total amount of diols is preferably 80 mol % or greater, more preferably 90 mol % or greater. When the amount thereof is 80 mol % or greater, it is preferable because the crystallinity of the resin improves, and desirable low temperature fixing ability and heat resistant storage stability are both achieved, and hardness of the resin tends to be improved.

The straight chain aliphatic diol is appropriately selected depending on the intended purpose without any limitation, and examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among them, preferred are ethylene glycol, 1,3-propanediol, 1,4-butanediol, 1,6-hexanediol, 1,9-nonanediol, and 1,10-decanediol, as they are readily available.

The branched aliphatic diol whose chain has 2 to 36 carbon atoms is appropriately selected depending on the intended purpose without any limitation, and examples thereof include 1,2-propylene glycol, butanediol, hexanediol, octanediol, decanediol, dodecanediol, tetradecanediol, neopentyl glycol, and 2,2-diethyl-1,3-propanediol.

The C4-C36 alkylene ether glycol is appropriately selected depending on the intended purpose without any limitation, and examples thereof include diethylene glycol, triethylene glycol, dipropylene glycol, polyethylene glycol, polypropylene glycol, and polytetramethylene ether glycol.

The C4-C36 alicyclic diol is appropriately selected depending on the intended purpose without any limitation, and examples thereof include 1,4-cyclohexane dimethanol, and hydrogenated bisphenol A.

The alkylene oxide (may be abbreviated as AO, hereinafter) of the alicyclic diol is appropriately selected depending on the intended purpose without any limitation, and examples thereof include an ethylene oxide (may be abbreviated as EO, hereinafter), propylene oxide (may be abbreviated as PO, hereinafter), or butylene oxide (may be abbreviated as BO, hereinafter) adduct (the number of moles added: 1 to 30) of the alicyclic diol.

The bisphenol is appropriately selected depending on the intended purpose without any limitation, and examples thereof include an AO (e.g., EO, PO, and BO) adduct (the number of moles added: 2 to 30) of bisphenol A, bisphenol F, or bisphenol S.

The polylactone diol is appropriately selected depending on the intended purpose without any limitation, and examples thereof include poly ϵ-caprolacone diol.

The diol having a carboxyl group is appropriately selected depending on the intended purpose without any limitation, and examples thereof include C6-C24 dialkylol alkanoic acid, such as 2,2-dimethylol priopionic acid (DMPA), 2,2-dimethylol butanoic acid, 2,2-dimethylol heptanoic acid, and 2,2-dimethylol octanoic acid.

The diol having a sulfonic acid group or sulfamic acid group is appropriately selected depending on the intended purpose without any limitation, and examples thereof include: sulfamic acid diol, such as N,N-bis(2-hydroxyalkyl) sulfamic acid (number of carbon atoms in the alkyl group: 1 to 6) (e.g., N,N-bis(2-hydroxyethyl)sulfamic acid), and an AO (e.g., EO and PO, number of moles of AO added: 1 to 6) adduct of N,N-bis(2-hydroxyalkyl)sulfamic acid (number of carbon atoms in the alkyl group: 1 to 6) (e.g., N,N-bis(2-hydroxyethyl)sulfamic acid PO (2 mol) adduct); and bis(2-hydroxyethyl)phosphate.

The neutralized salt group contained in the diol having a neutralized salt group is appropriately selected depending on the intended purpose without any limitation, and examples thereof include C3-C30 tertiary amine (e.g., triethyl amine), and alkali metal (e.g., sodium salt).

Among them, the C2-C12 alkylene glycol, diol having a carboxyl group, AO adduct of bisphenols, and any combination thereof are preferable.

Moreover, the optional trivalent to octavalent or higher polyol is appropriately selected depending on the intended purpose without any limitation, and examples thereof include: C3-C36 trihydric to octahydric or higher polyhydric aliphatic alcohol such as alkane polyol, and its intramolecular or intermolecular dehydrate (e.g., glycerin, trimethylol ethane, trimethylol propane, pentaerythritol, sorbitol, sorbitan, and polyglycerin), saccharide and derivatives thereof (e.g., sucrose, and methylglucoside); a trisphenol (e.g., trisphenol PA) AO adduct (number of moles added: 2 to 30); a novolak resin (e.g., phenol novolak, cresol novolak) AO adduct (number of moles added: 2 to 30); and acryl polyol, such as a copolymer of hydroxyethyl(meth)acrylate and a vinyl monomer. Among them, trihydric to octahydric or higher polyhydric aliphatic alcohol and a novolak resin AO adduct are preferable, and the novolak resin AO adduct is more preferable.

—Polycarboxylic Acid—

Examples of the polycarboxylic acid include dicarboxylic acid, and trivalent to hexavalent or higher polycarboxylic acid.

The dicarboxylic acid is appropriately selected depending on the intended purpose without any limitation, and preferable examples thereof include: aliphatic dicarboxylic acid, such as straight chain aliphatic dicarboxylic acid, and branched aliphatic dicarboxylic acid; and aromatic dicarboxylic acid. Among them, straight chain aliphatic dicarboxylic acid.

The aliphatic dicarboxylic acid is appropriately selected depending on the intended purpose without any limitation, and preferable examples thereof include: C4-C36 alkane dicarboxylic acid, such as succinic acid, adipic acid, sebacic acid, azelaic acid, dodecane dicarboxylic acid, octadecane dicarboxylic acid, and decyl succinic acid; C4-C36 alkene dicarboxylic acid, such as alkenyl succinic acid (e.g., dodecenyl succinic acid, pentadecenyl succinic acid, and octadecenyl succinic acid), maleic acid, fumaric acid, and citraconic acid; and C6-C40 alicyclic dicarboxylic acid, such as dimer acid (e.g., linoleic acid dimer).

The aromatic dicarboxylic acid is appropriately selected depending on the intended purpose without any limitation, and preferable examples thereof include: C8-C36 aromatic dicarboxylic acid, such as phthalic acid, isophthalic acid, terephthalic acid, t-butylisophthalic acid, 2,6-naphthalene dicarboxylic acid, 4,4'-biphenyl dicarboxylic acid.

Moreover, examples of the optional trivalent to hexavalent or higher polycarboxylic acid include C9-C20 aromatic polycarboxylic acid, such as trimellitic acid, and pyromellitic acid.

Note that, as the dicarboxylic acid or trivalent to hexavalent or higher polycarboxylic acid, acid anhydrides or C1-C4 lower alkyl ester (e.g., methyl ester, ethyl ester, and isopropyl ester) of the above-listed acids may be used.

Among the above-listed dicarboxylic acids, a use of the aliphatic dicarboxylic acid (preferably, adipic acid, sebacic acid, dodecane dicarboxylic acid, terephthalic acid, isophthalic acid, etc.) alone is particularly preferable. Use of a combination of the aliphatic dicarboxylic acid with the aromatic dicarboxylic acid (preferably terephthalic acid, isophthalic acid, t-butylisophthalic acid, lower alkyl ester of any of the above-listed aromatic dicarboxylic acids, etc.) is also preferable. In this case, an amount of the aromatic dicarboxylic acid copolymerized is preferably 20 mol % or smaller.

—Lactone Ring-Opening Polymerization Product—

The lactone ring-opening polymerization product is appropriately selected depending on the intended purpose without any limitation, and examples thereof include: a lactone ring-opening polymerization product obtained through a ring-opening polymerization of lactone, such as C3-C12 monolactone (number of ester groups in a ring: one) (e.g., β-propiolactone, γ-butylolactone, δ-valerolactone, and ϵ-caprolactone) with a catalyst (e.g., metal oxide, and an organic metal compound); and a lactone ring-opening polymerization product containing a terminal hydroxy group obtained by subjecting C3-C12 monolactones to ring-opening polymerization using glycol (e.g., ethylene glycol, and diethylene glycol) as an initiator.

The C3-C12 monolactone is appropriately selected depending on the intended purpose without any limitation, but it is preferably ϵ-caprolactone in view of crystallinity.

The lactone ring-opening polymerization product may be selected from commercial products, and examples of the commercial products include highly crystalline polycaprolactone such as H1P, H4, H5, and H7 of PLACCEL series manufactured by Daicel Corporation.

—Polyhydroxycarboxylic Acid—

The preparation method of the polyhydroxycarboxylic acid is appropriately selected depending on the intended purpose without any limitation, and examples thereof include a method in which hydroxycarboxylic acid such as glycolic acid, and lactic acid (e.g., L-lactic acid, D-lactic acid, and racemic lactic acid) is directly subjected to a dehydration-condensation reaction; and a method in which C4-C12 cyclic ester (the number of ester groups in the ring is 2 to 3), which is an equivalent to a dehydration-condensation product between 2 or 3 molecules of hydroxycarboxylic acid, such as glycolide or lactide (e.g., L-lactide acid, D-lactide, and racemic lactic acid) is subjected to a ring-opening polymerization using a catalyst such as metal oxide and an organic metal compound. The method using ring-opening polymerization is preferable because of easiness in adjusting a molecular weight of the resultant.

Among the cyclic esters listed above, L-lactide and D-lactide are preferable in view of crystallinity. Moreover, terminals of the polyhydroxycarboxylic acid may be modified to have a hydroxyl group or carboxyl group.

<<<Polyurethane Resin>>>

The polyurethane resin as the crystalline resin includes a polyurethane resin synthesized from polyol (e.g., diol, trihydric to octahydric or higher polyol) and polyisocyanate (e.g., diisocyanate, and trivalent or higher polyisocyanate). Among them, preferred is a polyurethane resin synthesized from the diol and the diisocyanate.

As for the diol and trihydric to octahydric or higher polyol, those mentioned as the diol and trihydric to octahydric or higher polyol listed in the description of the polyester resin can be used.

—Polyisocyanate—

The polyisocyanate includes, for example, diisocyanate, and trivalent or higher polyisocyanate.

The diisocyanate is appropriately selected depending on the intended purpose without any limitation, and examples thereof include aromatic diisocyanate, aliphatic diisocyanate, alicyclic diisocyanate, and aromatic aliphatic diisocyanate. Specific examples thereof include C6-C20 aromatic diisocyanate (the number of the carbon atoms excludes other than those contained in NCO groups, which is the same as follows), C2-C18 aliphatic diisocyanate, C4-C15 alicyclic diisocyanate, C8-C15 aromatic aliphatic diisocyanate, and modified products (e.g., modified products containing a urethane group, carboxylmide group, allophanate group, urea group, biuret group, uretdione group, uretimine group, isocyanurate group, or oxazolidone group) of the preceding diisocyanates, and a mixture of two or more of the preceding diisocyanates. Optionally, trivalent or higher isocyanate may be used in combination.

The aromatic diisocyanate is appropriately selected depending on the intended purpose without any limitation, and examples thereof include 1,3- and/or 1,4-phenylene diisocyanate, 2,4- and/or 2,6-tolylenediisocyanate (TDI), crude TDI, 2,4'- and/or 4,4'-diphenyl methane diisocyanate (MDI), crude MDI (e.g., a phosgenite product of crude diaminophenyl methane (which is a condensate between formaldehyde and aromatic amine (aniline) or a mixture thereof, or condensate of a mixture of diaminodiphenyl methane and a small amount (e.g., 5% by mass to 20% by mass) of trivalent or higher polyamine) and polyallylpolyisocyanate (PAPI)), 1,5-naphthalene diisocyanate, 4,4',4"-triphenylmethane triisocyanate, and m- and p-isocyanatophenylsulfonyl isocyanate.

The aliphatic diisocyanate is appropriately selected depending on the intended purpose without any limitation, and examples thereof include ethylene diisocyanate, tetramethylenediisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-diisocyanatohexanoate.

The alicyclic diisocyanate is appropriately selected depending on the intended purpose without any limitation, and examples thereof include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, and 2,5- and 2,6-norbornanediisocyanate.

The aromatic aliphatic diisocyanate is appropriately selected depending on the intended purpose without any limitation, and examples thereof include m- and p-xylene diisocyanate (XDI), and α,α,α',α'-tetramethylxylene diisocyanate (TMXDI).

Moreover, the modified product of the diisocyanate is appropriately selected depending on the intended purpose without any limitation, and examples thereof include modified products containing a urethane group, carboxylmide group, allophanate group, urea group, biuret group, uretdione group, uretimine group, isocyanurate group, or oxazolidone group. Specific examples thereof include: modified products of diisocyanate such as modified MDI (e.g., urethane-modified MDI, carbodiimide-modified MDI, and trihydrocarbylphosphate-modified MDI), and urethane-modified TDI (e.g., isocyanate-containing prepolymer); and a mixture of two or more of these modified products of diisocyanate (e.g., a combination of modified MDI and urethane-modified TDI).

Among these diisocyanates, C6-C15 aromatic diisocyanate (where the number of carbon atoms excludes those contained in NCO groups, which will be the same as follows), C4-C12 aliphatic diisocyanate, and C4-C15 alicyclic diisocyanate are preferable, and TDI, MDI, HDI, hydrogenated MDI, and IPDI are particularly preferable.

<<<Polyurea Resin>>>

The polyurea resin as the crystalline resin includes a polyurea resin synthesized from polyamine (e.g., diamine, and trivalent or higher polyamine) and polyisocyanate (e.g., diisocyanate, and trivalent or higher polyisocyanate). Among them, the polyurea resin synthesized from the diamine and the diisocyanate is preferable.

As for the diisocyanate and trivalent or higher polyisocyanate, those listed as the diisocyanate and trivalent or higher polyisocyanate in the description of the polyurethane resin can be used.

—Polyamine—

The polyamine includes, for example, diamine, and trivalent or higher polyamine.

The diamine is appropriately selected depending on the intended purpose without any limitation, and examples thereof include aliphatic diamine, and aromatic diamine. Among them, C2-C18 aliphatic diamine, and C6-C20 aromatic diamine are preferable. With this, the trivalent or higher amines may be used in combination, if necessary.

The C2-C18 aliphatic diamine is appropriately selected depending on the intended purpose without any limitation, and examples thereof include: C2-C6 alkylene diamine, such as ethylene diamine, propylene diamine, trimethylene diamine, tetramethylene diamine, and hexamethylene diamine; C4-C18 alkylene diamine, such as diethylene triamine, iminobispropyl amine, bis(hexamethylene)triamine, triethylene tetramine, tetraethylene pentamine, and pentaethylene hexamine; C1-C4 alkyl or C2-C4 hydroxyalkyl substitution products of the alkylene diamine or polyalkylene diamine, such as dialkylaminopropylamine, trimethylhexamethylene diamine, aminoethylethanolamine, 2,5-dimethyl-2,5-hexamethylene diamine, and methyl isobispropyl amine; C4-C15 alicyclic diamine, such as 1,3-diaminocyclohexane, isophorone diamine, menthane diamine, and 4,4'-methylene dichloroanilinehexane diamine (hydrogenated methylene dianiline); C4-C15 heterocyclic diamine, such as piperazine, N-aminoethyl piperazine, 1,4-diaminoethyl piperazine, 1,4-bis(2-amino-2-methylpropyl)piperazine, 3,9-bis(3-aminopropyl-2,4,8,10-tetraoxapiro[5,5]undecane; and C8-C15 aromatic ring-containing aliphatic amines such as xylylene diamine, and tetrachloroaniline-p-xylylene diamine.

The C6-C20 aromatic diamine is appropriately selected depending on the intended purpose without any limitation, and examples thereof include: non-substituted aromatic diamine, such as 1,2-, 1,3-, or 1,4-phenylene diamine, 2,4'-, or 4,4'-diphenylmethane diamine, crude diphenyl methane diamine(polyphenyl polymethylene polyamine), diamine diphenyl sulfone, benzidine, thiodianiline, bis(3,4-diaminephenyl)sulfone, 2,6-diamine pyridine, m-aminobenzyl amine, triphenylmethane-4,4',4"-triamine, and naphthylene diamine; aromatic diamine having a C1-C4 nuclear-substituted alkyl group, such as 2,4-, or 2,6-tolylene diamine, crude tolylene diamine, diethyltolylene diamine, 4,4'-diamine-3,3'-dimethyldiphenyl methane, 4,4'-bis(o-toluidine), dianisidine, diamine ditolylsulfone, 1,3-dimethyl-2,4-diamine benzene, 1,3-dimethyl-2,6-diamine benzene, 1,4-diisopropyl-2,5-diamine benzene, 2,4-diamine mesitylene, 1-methyl-3,5-diethyl-2,4-diamine benzene, 2,3-dimethyl-1,4-diamine naphthalene, 2,6-dimethyl-1,5-diamine naphthalene, 3,3',5,5-tetramethylbenzidine, 3,3',5,5'-tetramethyl-4,4'-diamine diphenyl methane, 3,5-diethyl-3'-methyl-2',4-diamine diphenyl methane, 3,3'-diethyl-2,2'-diamine diphenyl methane, 4,4'-diamine-3,3'-dimethyl diphenyl methane, 3,3',5,5'-tetraethyl-4,4'-diamine benzophenone, 3,3',5,5'-tetraethyl-4,4'-diamine diphenyl ether, and 3,3',5,5'-tetraisopropyl-4,4'-diamine diphenyl sulfone; a mixture of isomers of the above-listed non-substituted aromatic diamine and/or aromatic diamine having C1-C4 nuclear-substituted alkyl group with various blending ratios; methylenebis-o-chloroanilineaniline, 4-chloroaniline-o-phenylene diamine, 2-chloroaniline-1,4-phenylene diamine, 3-amino-4-chloroanilineaniline, 4-bromo-1,3-phenylene diamine, 2,5-dichloroaniline-1,4-phenylene diamine, 5-nitro-1,3-phenylene diamine, and 3-dimethoxy-4-aminoaniline; aromatic diamine having a nuclear-substituted electron-withdrawing group (e.g., halogen, such as Cl, Br, I, and F; an alkoxy group, such as a methoxy group, and an ethoxy group; and a nitro group), such as 4,4'-diamine-3,3'-dimethyl-5,5'-dibromo-diphenyl methane, 3,3'-dichloroanilinebenzidine, 3,3'-dimethoxybenzidine, bis(4-amino-3-chloroanilinephenyl)oxide, bis(4-amino-2-chloroanilinephenyl)propane, bis(4-amino-2-chloroanilinephenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), 4-aminophenyl-2-chloroanilineaniline; and aromatic diamine having a secondary amino group [part of or entire primary amino groups in the non-substituted aromatic diamine, the aromatic diamine having C1-C4 nuclear-substituted alkyl group, the mixture of isomers thereof with various blending ratios, and aromatic diamine having a nuclear-substituted electron-withdrawing group are replaced with secondary amino groups by substitution with a lower alkyl group, such as a methyl group, and an ethyl group], such as 4,4'-di(methylamino)diphenyl methane, and 1-methyl-2-methylamino-4-amino benzene.

Other examples of the diamine include: polyamide polyamine, such as low molecular weight polyamide polyamine obtained by dicarboxylic acid (e.g., dimer acid) and an excess amount (two moles or more per mole of acid) of the polyamine (e.g., the alkylene diamine, and the polyalkylenepolyamine): and polyether polyamine, such as a hydrogenated compound of cyanoethylated compound of polyether polyol (e.g., polyalkylene glycol).

<<<Polyamide Resin>>>

The polyamide resin as the crystalline resin includes a polyamide resin synthesized from polyamine (e.g., diamine, and trivalent or higher polyamine), and polycarboxylic acid (e.g., dicarboxylic acid, and trivalent to hexavalent or higher polycarboxylic acid). Among them, the polyamide resin synthesized from diamine and dicarboxylic acid is preferable.

As for the diamine and trivalent or higher polyamine, those listed as the diamine and trivalent or higher polyamine in the description of the polyurea resin can be used.

As for the dicarboxylic acid and trivalent to hexavalent or higher polycarboxylic acid, those listed as the dicarboxylic acid and trivalent to hexavalent or higher polycarboxylic acid in the description of the polyester resin can be used.

<<<Polyether Resin>>>

The polyether resin as the crystalline resin is appropriately selected depending on the intended purpose without any limitation, and examples thereof include crystalline polyoxy alkylene polyol.

The preparation method of the crystalline polyoxyalkylene polyol is appropriately selected depending on the intended purpose without any limitation, and examples thereof include: a method in which chiral AO is subjected to ring-opening polymerization using a catalyst that is commonly used for a polymerization of AO (e.g., a method described in Journal of the American Chemical Society, 1956, Vol. 78, No. 18, pp. 4787-4792); and a method in which inexpensive racemic AO is subjected to ring-opening polymerization using a catalyst that is a complex having a three-dimensionally bulky unique chemical structure.

As for a method using a unique complex, known are a method using, as a catalyst, a compound in which a lanthanoid complex is made in contact with organic aluminum (for example, disclosed in JP-A No. 11-12353), and a method in which bimetal μ-oxoalkoxide and a hydroxyl compound are allowed to react in advance (for example, disclosed in JP-A No. 2001-521957).

Moreover, as for a method for obtaining crystalline polyoxy alkylene polyol having extremely high isotacticity, known is a method for using a salen complex (for example, disclosed in Journal of the American Chemical Society, 2005, vol. 127, no. 33, pp. 11566-11567). For example, polyoxy alkylene glycol having a hydroxyl group at terminal thereof, which has isotacticity of 50% or greater is obtained through ring-opening polymerization of chiral AO using glycol or water as an initiator. The polyoxy alkylene glycol, which has the isotacticity of 50% or greater, may be one a terminal of which is modified, for example, to have a carboxyl group. Note that, the isotacticity of 50% or greater typically gives crystallinity. Examples of the glycol include the aforementioned diol, and examples of carboxylic acid used for carboxy modification include the aforementioned dicarboxylic acid.

As for AO used for the production of the crystalline polyoxy alkylene polyol, C3-C9 AO is included. Examples thereof include PO, 1-chloroanilineoxetane, 2-chloroanilineoxetane, 1,2-dichloroanilineoxetane, epichloroanilinehydrin, epibromohydrin, 1,2-BO, methyl glycidyl ether, 1,2-pentylene oxide, 2,3-pentylene oxide, 3-methyl-1,2-butylene oxide, cyclohexene oxide, 1,2-hexylene oxide, 3-methyl-1,2-pentylene oxide, 2,3-hexylene oxide, 4-methyl-2,3-pentylene oxide, allyl glycidyl ether, 1,2-heptylene oxide, styrene oxide, and phenyl glycidyl ether. Among these AO, PO, 1,2-BO, styrene oxide, and cyclohexene oxide are preferable, and PO, 1,2-BO, and cyclohexene oxide are more preferable. Moreover these AO may be used alone, or in combination.

Moreover, the isotacticity of the crystalline polyoxy alkylene polyol is preferably 70% or greater, more preferably 80% or greater, even more preferably 90% or greater, and even more preferably 95% or greater, in view of high sharp melting, and blocking resistance of a resulting crystalline polyether resin.

The isotacticity can be calculated by the method disclosed in Macromolecules, vol. 35, no. 6, pp. 2389-2392 (2002), and can be determined in the following manner.

A measuring sample (about 30 mg) is weight in a sample tube for $^{13}$C-NMR having a diameter of 5 mm. To this, about 0.5 mL of a deuterated solvent is added to dissolve the sample, to thereby prepare an analysis sample. Here, the deuterated solvent is appropriately selected from solvents that can dissolve the sample, without any limitation, and examples thereof include deuterated chloroanilineform, deuterated toluene, deuterated dimethyl sulfoxide, and deuterated dimethyl formamide. Three signals of $^{13}$C-NMR due to a methine group are appeared at around the syndiotactic value (S) 75.1 ppm, around the heterotactic value (H) 75.3 ppm, and around isotactic value (I) 75.5 ppm, respectively.

The isotacticity is calculated by the following calculating formula (1).

$$\text{Isotacticity (\%)}=[I/(I+S+H)]\times 100 \qquad \text{Calculating Formula (1)}$$

In the calculating formula (1), "I" denotes an integral value of the isotactic signal, "S" denotes an integral value of the syndiotactic signal, and "H" denotes an integral value of the heterotactic signal.

<<<Vinyl Resin>>>

The vinyl resin as the crystalline resin is appropriately selected depending on the intended purpose without any limitation, provided that it has crystallinity, but it is preferably a vinyl resin having as a constitutional unit a crystalline vinyl monomer, and optionally non-crystalline vinyl monomer.

The crystalline vinyl monomer is appropriately selected depending on the intended purpose without any limitation, and preferable examples thereof include C12-C50 straight chain alkyl(meth)acrylate (C12-C50 straight chain alkyl group is a crystalline group), such as lauryl(meth)acrylate, tetradecyl(meth)acrylate, stearyl(meth)acrylate, eicosyl (meth)acrylate, and behenyl(meth)acrylate.

The non-crystalline vinyl monomer is appropriately selected depending on the intended purpose without any limitation, but it is preferably a vinyl monomer having a molecular weight of 1,000 or smaller. Examples thereof include styrene, a (meth)acryl monomer, a vinyl monomer containing a carboxyl group, other vinyl ester monomers, and an aliphatic hydrocarbon-based vinyl monomer. These may be used alone, or in combination.

The styrene is appropriately selected depending on the intended purpose without any limitation, and examples thereof include styrene, and alkyl styrene where the number of carbon atoms in the alkyl group is 1 to 3.

The (meth)acryl monomer is appropriately selected depending on the intended purpose without any limitation, and examples thereof include: C1-C11 alkyl(meth)acrylate, and C12-C18 branched alkyl(meth)acrylate, such as methyl (meth)acrylate, ethyl(meth)acrylate, butyl(meth)acrylate, and 2-ethylhexyl(meth)acrylate; hydroxylalkyl(meth)acrylate where the alkyl group has 1 to 11 carbon atoms, such as hydroxylethyl(meth)acrylate; and alkylamino group-containing (meth)acrylate where the alkyl group contains 1 to 11 carbon atoms, such as dimethylaminoethyl(meth)acrylate, and diethylaminoethyl(meth)acrylate.

The carboxyl group-containing vinyl monomer is appropriately selected depending on the intended purpose without any limitation, and examples thereof include: C3-C15 monocarboxylic acid such as (meth)acrylic acid, crotonic acid, and cinnamic acid; C4-C15 dicarboxylic acid such as maleic acid (anhydride), fumaric acid, itaconic acid, and citraconic acid; dicarboxylic acid monoester, such as monoalkyl (C1-C18) ester of dicarboxylic acid (e.g., maleic acid monoalkyl ester, fumaric acid monoalkyl ester, itaconic acid monoalkyl ester, and citraconic acid monoalkyl ester).

Other vinyl monomers are appropriately selected depending on the intended purpose without any limitation, and examples thereof include: C4-C15 aliphatic vinyl ester such as vinyl acetate, vinyl propionate, and isopropenyl acetate; C8-C50 unsaturated carboxylic acid polyhydric (dihydric to trihydric or higher) alcohol ester such as ethylene glycol di(meth)acrylate, propylene glycol di(meth)acrylate, neopentyl glycol di(meth)acrylate, trimethylolpropane tri(meth) acrylate, 1,6-hexanediol diacrylate, and polyethylene glycol di(meth)acrylate; and C9-C15 aromatic vinyl ester such as methyl-4-vinylbenzoate.

The aliphatic hydrocarbon vinyl monomer is appropriately selected depending on the intended purpose without any limitation, and examples thereof include: C2-C10 olefin such as ethylene, propylene, butene, and octene; and C4-C10 diene such as butadiene, isoprene, and 1,6-hexadiene.

<<<Resin Containing Crystalline Polyester Unit>>>

As for the crystalline resin, a resin containing a crystalline polyester unit can be preferably used.

Examples of the resin containing a crystalline polyester unit include a resin composed of only crystalline polyester units (may be also referred to merely as a crystalline polyester resin), a resin where a crystalline polyester unit is linked, and a resin where a crystalline polyester unit is bonded to another polymer (e.g., so-called block polymer, and graft polymer). A large area of the resin composed only crystalline polyester units takes a crystalline structure, but such resin may be easily deformed by external force. The reason thereof is as follows. It is difficult to crystalline the entire area of the crystalline polyester, and molecular chains in the portions that are not crystallized (non-crystalline segments) have high freedom and therefore easily deformed. In addition, regarding the portions thereof which take a crystalline structure, a higher order structure thereof is a so-called lamellae structure, where plains each formed by folding a molecular chain is laminated, and lamella layers are easily moved, as there is no strong binding force between the lamella layers. If the binder resin for a toner is easily deformed by external force, it is possible to cause problems. For example, toner particles are deformed and aggregated inside an image forming apparatus, a toner is deposited on or fused onto a member, and a finally output image is easily scratched. Accordingly, the binder resin needs to have a certain resistance to deformation upon application of external force, and to have toughness.

In order to provide toughness to the resin, preferred are a resin where crystalline polyester units having a urethane bond segment, a urea bond segment or a phenylene segment, which has a large aggregation energy, are linked, and a resin where a crystalline polyester unit is bonded to another polymer (e.g., block polymer, and graft polymer). Among them, to have a urethane bond segment or urea bond segment is preferable, because the presence of the urethane bond segment or urea bond segment in a molecular chain enables to form apparent crosslinking points in a non-crystalline segment or between lamella layers due to large intermolecular force, and a resulting toner can be easily wet to paper after being fixed on the paper and therefore fixing strength can be enhanced.

—Crystalline Polyester Unit—

Examples of the crystalline polyester unit include: a polycondensate polyester unit synthesized from polyol and polycarboxylic acid; a lactone ring-opening polymerization product; and polyhydroxycarboxylic acid. Among them, a polycondensate polyester unit synthesized from diol and dicarboxylic acid is preferable in view of exhibiting crystallinity.

—Resin where Crystalline Polyester Units are Linked—

As for a method for preparing the resin where crystalline polyester units are linked, there is a method containing preparing a crystalline polyester resin containing active hydrogen, such as a hydroxyl group, at a terminal thereof in advance, and linking with polyisocyanate. This method can introduce the urethane bond segment in the resin skeleton, and therefore toughness of the resin can be enhanced.

Examples of polyisocyanate include diisocyanate, and trivalent or higher polyisocyanate.

—Resin where Crystalline Polyester Unit is Bonded to Another Polymer—

Examples of a method for preparing a resin where a crystalline polyester unit is bonded to another polymer include: a method containing preparing a crystalline polyester unit and another polymer unit separately in advance, and bonding these units; a method containing preparing either a crystalline polyester unit or another polymer unit in advance, followed by polymerizing, in the presence of the prepared units, the other polymer to bond these units; and a method containing simultaneously or successively polymerizing a crystalline polyester unit and another polymer unit in the same reaction system. The first method or second method described below are preferable, as a reaction is easily controlled according to the intended design.

The first method is a method containing, similarly to the aforementioned method for preparing crystalline polyester units are linked, preparing a unit containing active hydrogen (e.g., a hydroxyl group) at a terminal thereof in advance, and linking with polyisocyanate. As for the polyisocyanate, those mentioned above can be used. In addition, the resin can be also obtained by a method containing introducing an isocyanate group at a terminal of one unit, and reacting with active hydrogen of the other unit. In accordance with this method, a urethane bond segment can be introduced into a resin skeleton, and therefore toughness of the resin can be enhanced.

As for the second method, in the case where a crystalline polyester unit is prepared first and the polymer unit to be produced next is a non-crystalline polyester unit, polyurethane unit, or polyurea unit, a hydroxyl group or a carboxyl group at a terminal of the crystalline polyester unit is reacted with a monomer for preparing another polymer unit, to thereby produce a resin where the crystalline polyester unit is bonded to another polymer unit.

—Non-Crystalline Polyester Unit—

Examples of the non-crystalline polyester unit include a polycondensate polyester unit synthesized from polyol and polycarboxylic acid. As for the polyol and polycarboxylic acid, those listed in the description of the crystalline polyester unit above can be used. In order to design the non-crystalline polyester unit not to give crystallinity, a large numbers of folding points or branch points can be provided in a polymer skeleton. In order to provide a folding point, usable are, for example, as polyol, an AO (e.g., EO, PO, and BO) adduct (number of moles added: 2 to 30) of bisphenol A, bisphenol F, or bisphenol S, or a derivative thereof; and as polycarboxylic acid, phthalic acid, isophthalic acid, or t-butyl isophthalic acid. In order to introduce a branch point, moreover, trihydric or higher polyol or polycarboxylic acid can be used.

<<<Copolymer Containing Crystalline Polyester Unit and Polyurethane Unit>>>

As for the crystalline resin, a copolymer containing a crystalline polyester unit and a polyurethane unit can be preferably used. The polyurethane unit has large aggregation energy and therefore it can impart toughness to the resin.

—Polyurethane Unit—

Examples of the polyurethane unit include: a polyurethane unit synthesized from polyol (e.g., diol, and trihydric to octahydric or higher polyol) and polyisocyanate (e.g., diisocyanate, and trivalent or higher polyisocyanate). Among them, preferred is a polyurethane unit synthesized from diol and diisocyanate.

As for diol, and trihydric to octahydric or higher polyol, ones the same or similar to the diol, and trihydric to octahydric or higher polyol listed in the description of the polyester resin can be used.

As for diisocyanate, and trivalent or higher polyisocyanate, ones the same or similar to the aforementioned diisocyanate, and trivalent or higher polyisocyanate can be used.

<<Non-Crystalline Resin>>

The non-crystalline resin has glass transition temperature of −60° C. or higher but lower than 0° C., as measured by a differential scanning calorimeter (DSC). By designing the non-crystalline resin to have the glass transition temperature of −60° C. or higher but lower than 0° C., a softening point of the binder resin as a whole is sifted to the side of low temperature, to thereby improve low temperature fixing ability of a resulting toner. The glass transition temperature thereof is preferably −10° C. or lower, more preferably −30° C. or lower.

As mentioned earlier, the crystalline resin and the non-crystalline resin are preferably compatible to each other in the toner of the present invention, and therefore the crystalline resin and the non-crystalline resin are preferably both polyester resins.

An example where the non-crystalline resin is a non-crystalline resin is explained hereinafter.

The non-crystalline polyester resin is formed from a non-linear reactive precursor a and a curing agent. The reactive precursor a is polyester containing a reaction active point, such as isocyanate, epoxy, and carbodiimide, at a terminal thereof, and is particularly preferably a terminal NCO-modified product of polyester-based polyurethane.

As for the polyhydric alcohol component in the polyester, any polyhydric alcohol known in the art can be used alone, or in combination, but in view of blocking resistance, storage stability of an image, and low temperature fixing ability, aliphatic diol, such as 3-methyl-1,5-pentanediol and neopentyl glycol, is preferable. As for the acid component, any acid known in the art can be used alone, or in combination, but in view of the cost, terephthalic acid, isophthalic acid, phthalic anhydride, adipic acid, sebacic acid, and dodecane dicarboxylic acid.

As for a non-linear component, i.e., a component that can be formed into a branched structure, a trivalent or higher polyfunctional component known in the art can be used, but in view of the cost, trimethylol propane as the alcohol, and trimellitic anhydride as the acid are preferable.

Examples of diisocyanate as the isocyanate component include C6-C20 aromatic diisocyanate (the number of the carbon atoms excludes other than those contained in NCO groups, which is the same as follows), C2-C18 aliphatic diisocyanate, C4-C15 alicyclic diisocyanate, C8-C15 aromatic aliphatic diisocyanate, and modified products (e.g., modified products containing a urethane group, carboxylmide group, allophanate group, urea group, biuret group, uretdione group, uretimine group, isocyanurate group, or oxazolidone group) of the preceding diisocyanates, and a mixture of two or more of the preceding diisocyanates.

Optionally, trivalent or higher isocyanate may be used in combination.

Specific examples of the aromatic diisocyanate (including trivalent or higher polyisocyanate) include 1,3- and/or 1,4-phenylene diisocyanate, 2,4- and/or 2,6-tolylenediisocyanate (TDI), crude TDI, 2,4'- and/or 4,4'-diphenyl methane diisocyanate (MDI), crude MDI (e.g., a phosgenite product of crude diaminophenyl methane (which is a condensate between formaldehyde and aromatic amine (aniline) or a mixture thereof, or condensate of a mixture of diaminodiphenyl methane and a small amount (e.g., 5% by mass to 20% by mass) of trivalent or higher polyamine) and polyallylpolyisocyanate (PAPI)), 1,5-naphthalene diisocyanate, 4,4',4"-triphenylmethane triisocyanate, and m- and p-isocyanatophenylsulfonyl isocyanate.

Specific examples of the aliphatic diisocyanate (including trivalent or higher polyisocyanate) include ethylene diisocyanate, tetramethylenediisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-diisocyanatohexanoate.

Specific examples of the alicyclic diisocyanate include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, and 2,5- and 2,6-norbornanediisocyanate.

Specific examples of the aromatic aliphatic diisocyanate include m- and p-xylene diisocyanate (XDI), and $\alpha,\alpha,\alpha',\alpha'$-tetramethylxylene diisocyanate (TMXDI).

Moreover, examples of the modified product of the diisocyanate include modified products containing a urethane group, carboxylmide group, allophanate group, urea group, biuret group, uretdione group, uretimine group, isocyanurate group, or oxazolidone group.

Specific examples thereof include modified MDI (e.g., urethane-modified MDI, carbodiimide-modified MDI, and trihydrocarbylphosphate-modified MDI), and urethane-modified TDI (e.g., isocyanate-containing prepolymer); and a mixture of two or more of these modified products of diisocyanate (e.g., a combination of modified MDI and urethane-modified TDI).

Among them, C6-C15 aromatic diisocyanate (where the number of carbon atoms excludes those contained in NCO groups, which will be the same as follows), C4-C12 aliphatic diisocyanate, and C4-C15 alicyclic diisocyanate are preferable, and TDI, MDI, HDI, hydrogenated MDI, and IPDI are particularly preferable.

As for the curing agent, an amine compound known in the art can be suitably used.

As for examples of diamine (including optionally used trivalent or higher polyamine), aliphatic diamine (C2 to C18) include: [1] aliphatic diamine, such as C2-C6 alkylene diamine (e.g., ethylene diamine, propylene diamine, trimethylene diamine, tetramethylene diamine, and hexamethylene diamine), and polyalkylene (C2 to C6) diamine (e.g., diethylene triamine, iminobispropyl amine, bis(hexamethylene) triamine, triethylene tetramine, tetraethylene pentamine, and pentaethylene hexamine); [2] alkyl (C1 to C4) or hydroxyalkyl (C2 to C4) substitution product thereof, such as dialkyl (C1 to C3)aminopropyl amine, trimethylhexamethylene diamine, aminoethylethanolamine, 2,5-dimethyl-2,5-hexamethylene diamine, and methyl isobispropyl amine; [3] alicyclic ring or heterocyclic ring-containing aliphatic diamine, such as alicyclic diamine (C4 to C15) (e.g., 1,3-diaminocyclohexane, isophorone diamine, menthane diamine, and 4,4'-methylene dichloroanilinehexane diamine (hydrogenated methylene dianiline), and heterocyclic diamine (C4 to C15) (e.g., piperazine, N-aminoethyl piperazine, 1,4-diaminoethyl piperazine, 1,4-bis(2-amino-2-methylpropyl)piperazine, and 3,9-bis(3-aminopropyl)-2,4,8,10-tetraoxapiro[5,5]undecane); and [4] aromatic ring-containing aliphatic amine (C8 to C15), such as xylylene diamine, and tetrachloroaniline-p-xylylene diamine.

Examples of the aromatic diamine (C6 to C20) include: [1] non-substituted aromatic diamine (e.g., 1,2-, 1,3-, or 1,4-phenylene diamine, 2,4'-, or 4,4'-diphenylmethane diamine, crude diphenyl methane diamine(polyphenyl polymethylene polyamine), diamine diphenyl sulfone, benzidine, thiodianiline, bis(3,4-diaminephenyl)sulfone, 2,6-diamine pyridine, m-aminobenzyl amine, triphenylmethane-4,4',4"-triamine, and naphthylene diamine); [2] nucleus-substituted alkyl group (e.g., C1-C4 alkyl group, such as methyl, ethyl, n- or i-propyl, and butyl) containing aromatic diamine, such as 2,4-, or 2,6-tolylene diamine, crude tolylene diamine, diethyltolylene diamine, 4,4'-diamine-3,3'-dimethyldiphenyl methane, 4,4'-bis(o-toluidine), dianisidine, diamine ditolylsulfone, 1,3-dimethyl-2,4-diamine benzene, 1,3-dimethyl-2,6-diamine benzene, 1,4-diisopropyl-2,5-diamine benzene, 2,4-diamine mesitylene, 1-methyl-3,5-diethyl-2,4-diamine benzene, 2,3-dimethyl-1,4-diamine naphthalene, 2,6-dimethyl-1,5-diamine naphthalene, 3,3',5,5'-tetramethylbenzidine, 3,3',5,5'-tetramethyl-4,4'-diamine diphenyl methane, 3,5-diethyl-3'-methyl-2',4-diamine diphenyl methane, 3,3'-diethyl-2,2'-diamine diphenyl methane, 4,4'-diamine-3,3'-dimethyl diphenyl methane, 3,3',5,5'-tetraethyl-4,4'-diamine benzophenone, 3,3',5,5'-tetraethyl-4,4'-diamine diphenyl ether, and 3,3',5,5'-tetraisopropyl-4,4'-diamine diphenyl sulfone, and a mixture of isomers thereof with various blending ratios; [3] a nucleus substituted electron withdrawing group (e.g., halogen, such as Cl, Br, I, and F; an alkoxy group, such as a methoxy group, and an ethoxy group; and a nitro group) containing aromatic diamine (e.g., methylene bis-o-chloroanilineaniline, 4-chloro-o-phenylene diamine, 2-chloro-1,4-phenylenediamine, 3-amino-4-chloroanilineaniline, 4-bromo-1,3-phenylenediamine, 2,5-dichloro-1,4-phenylenediamine, 5-nitro-1,3-phenylenediamine, 3-dimethoxy-4-aminoaniline; 4,4'-diamino-3,3'-dimethyl-5,5'-dibromo-diphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), and 4-aminophenyl-2-chloroanilineaniline); and [4] secondary amino group containing aromatic diamine, such as aromatic diamine of [1] to [3] part or entire —$NH_2$ of which are substituted with —NH—R' (R' is an alkyl group, for example a lower alkyl group, such as methyl, and ethyl) (e.g., 4,4'-di(methylamino)diphenylmethane, and 1-methyl-2-methylamino-4-aminobenzene).

Other examples of the diamine component include polyamide polyamine, such as low molecular weight polyamide polyamine obtained by dicarboxylic acid (e.g., dimer acid) and an excess amount (two moles or more per mole of acid) of the polyamine (e.g., the alkylene diamine, and the polyalkylenepolyamine); and polyether polyamine, such as a hydrogenated compound of cyanoethylated compound of polyether polyol (e.g., polyalkylene glycol).

<Colorant>

The colorant is not particularly limited and may be appropriately selected from known dyes and pigments depending on the intended purpose. Examples of the pigment include carbon blacks, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fiser Red, parachloroanilineorthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, ultramarine blue, iron blue, anthraquinone blue, fast violet B, methylviolet lake, cobalt purple, manganese violet, dioxane violet, anthraquinone violet, chrome green, zinc green, chromium oxide, viridian green, emerald green, pigment green B, naphthol green B, green gold, acid green lake, malachite green lake, phthalocyanine green, anthraquinone green, titanium oxide, zinc flower, and lithopone. These may be used alone or in combination.

A color of the colorant is appropriately selected depending on the intended purpose without any limitation, and examples thereof include the colorant for black, and the colorant for a color, such as magenta, cyan, and yellow. These may be used alone or in combination.

Examples of the colorant for black include: carbon black (C.I. Pigment Black 7), such as furnace black, lamp black, acetylene black, and channel black; metal, such as copper, and iron (C.I. Pigment Black 11), and titanium oxide; and an organic pigment, such as aniline black (C.I. Pigment Black 1).

Examples of the colorant for magenta include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, 211; C.I. Pigment Violet 19; and C.I. Violet 1, 2, 10, 13, 15, 23, 29, 35.

Examples of the colorant for cyan include: C.I. Pigment Blue 2, 3, 15, 15:1, 15:2, 15:3, 15:4, 15:6, 16, 17, 60; C.I. Vat Blue 6; C.I. Acid Blue 45 or a copper phthalocyanine pigment having 1 to 5 phthalimide methyl groups substituted in a phthalocyanine skeleton thereof; and C.I. Pigment Green 7, and C.I. Pigment Green 36.

Examples of the colorant for yellow include: C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 180; C.I. Vat Yellow 1, 3, 20; and C.I. Pigment Orange 36.

An amount of the colorant in the toner is appropriately selected depending on the intended purpose without any limitation, but the amount thereof is preferably 1% by mass to 15% by mass, more preferably 3% by mass to 10% by mass. When the amount thereof is smaller than 1% by mass, the coloring ability of the toner may be insufficient. When the amount thereof is greater than 15% by mass, the pigment may cause dispersion failures in the toner, which may lead to low coloring ability, and undesirable electric property of the toner.

The colorant may be used as a master batch, in which the colorant forms a composite with a resin. The resin for the master batch is appropriately selected from conventional resins depending on the intended purpose without any limitation. Examples thereof include: a styrene polymer and substituted products thereof, a styrene-based copolymer; a polymethyl methacrylate resin; a polybutyl methacrylate resin; a polyvinyl chloride resin; a polyvinyl acetate resin; a polyethylene resin; a polypropylene resin; a polyester resin; an epoxy resin, an epoxy polyol resin; a polyurethane resin; a polyamide resin; a polyvinyl butyral resin; a polyacrylic acid resin; rosin; modified rosin; a terpene resin; an aliphatic hydrocarbon resin; an alicyclic hydrocarbon resin; an aromatic petroleum resin; chlorinated paraffin; and paraffin wax. These may be used alone, or in combination.

Examples of the styrene polymer and substituted product thereof include a polyester resin, a polystyrene resin, a poly (p-chloroanilinestyrene) resin, and a polyvinyl toluene resin. Examples of the styrene-based copolymer include a styrene-p-chloroanilinestyrene copolymer, a styrene-propylene copolymer, a styrene-vinyltoluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, styrene-methyl-α-chloroanilinemethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, and a styrene-maleic acid ester copolymer.

Moreover, there is no problem that the resin for the master batch may be the binder resin of the present invention, such as the crystalline resin.

The master batch can be produced by mixing and/or kneading the resin for the master batch and the colorant together through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, a high-shearing disperser (e.g., a three-roll mill) is preferably used.

<Releasing Agent>

The releasing agent is appropriately selected from those known in art depending on the intended purpose without any limitation, and examples thereof include wax, such as carbonyl group-containing wax, polyolefin wax, and long chain hydrocarbon. These may be used alone, or in combination. Among them carbonyl group-containing wax is preferable.

Examples of the carbonyl group-containing wax include polyalkanoic acid ester, polyalkanol ester, polyalkanoic acid amide, polyalkyl amide, and dialkyl ketone.

Examples of the polyalkanoic acid ester include carnauba wax, montan wax, trimethylolpropane tribehenate, pentaerythritol tetrabehenate, pentaerythritol diacetate dibehenate, glycerin tribehenate, and 1,18-octadecanediol distearate.

Examples of the polyalkanol ester include tristearyl trimellitate, and distearyl maleate. Examples of the polyalkanoic acid amide include dibehenyl amide. Examples of the polyalkyl amide include trimellitic acid tristearyl amide. Examples of the dialkyl ketone include distearyl ketone. Among the carbonyl group-containing wax mentioned above, polyalkanoic acid ester is particularly preferable.

Examples of the polyolefin wax include polyethylene wax, and polypropylene wax.

Examples of the long chain hydrocarbon include paraffin wax, and sasol wax.

The melting point of the releasing agent is appropriately selected depending on the intended purpose without any limitation, but it is preferably 40° C. to 160° C., more preferably 50° C. to 120° C., and even more preferably 60° C. to 90° C. When the melting point thereof is lower than 40° C., use of such releasing agent may adversely affect the heat resistant storage stability of the resulting toner. When the melting point thereof is higher than 160° C., the resulting toner is likely to cause cold offset during the fixing at low temperature.

The melting point of the releasing agent can be measured, for example, by means of a differential scanning calorimeter (DSC210, Seiko Instruments Inc.) in the following manner. A sample of the releasing agent is heated to 200° C., cooled from 200° C. to 0° C. at the cooling rate of 10° C./min, followed by heating at the heating rate of 10° C./min. The maximum peak temperature of heat of melting as obtained is determined as a melting point of the releasing agent.

A melt viscosity of the releasing agent, which is measured at the temperature higher than the melting point of the releasing agent by 20° C., is preferably 5 cps to 1,000 cps, more preferably 10 cps to 100 cps. When the melt viscosity thereof is lower than 5 cps, the releasing ability of the toner may be degraded. When the melt viscosity thereof is higher than 1,000 cps, the effect of improving hot offset resistance and low temperature fixing ability may not be attained.

An amount of the releasing agent in the toner is appropriately selected depending on the intended purpose without any limitation, but it is preferably 1% by mass to 40% by mass, more preferably 3% by mass to 30% by mass. When the amount thereof is greater than 40% by mass, flowability of a resulting toner may be impaired.

<Other Components>

The toner of the present invention may contain, in addition to the binder resin, the colorant, and the releasing agent, other components, such as an organic-modified layered inorganic mineral, a charge controlling agent, external additives, a flow improving agent, a cleaning improving agent, and a magnetic material, if necessary.

<<Charge Controlling Agent>>

The charge controlling agent is appropriately selected depending on the intended purpose without any limitation, but it is preferably a material that is clear, and/or close to white in color, as use of a color material may change a color tone of a resulting toner. Examples of the charge controlling agent include a triphenyl methane-based dye, a molybdic acid chelate pigment, a rhodamine dye, alkoxy amine, quaternary ammonium salt (including fluorine-modified quaternary ammonium salt), alkyl amide, phosphorus or a phosphorus compound, tungsten or a tungsten compound, a fluorine-based active agent, a metal salt of salicylic acid, and a metal salt of a salicylic acid derivative. These may be used alone, or in combination.

The charge controlling agent may be selected from commercial products. Examples of the commercial product thereof include: quaternary ammonium salt BONTRON P-51, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by Clariant K.K.); LRA-901, and a boron complex LR-147 (both manufactured by Japan Carlit Co., Ltd.); quinacridon; an azo-based pigment; and a polymer compound having a functional group, such as a sulfonic acid group, a carboxyl group, and quaternary ammonium salt.

The charge controlling agent may be melt-kneaded with the master batch, and then be dissolved and/or dispersed, or may be added when it is dissolved and/or dispersed together with other components of the toner. Alternatively, the charge controlling agent may be fixed on surfaces of toner particles after the production of the toner particles.

An amount of the charge controlling agent in the toner varies depending on the binder resin for use, the presence or absence of additives, or a dispersing method, and therefore cannot be defined unconditionally. For example, the amount of the charge controlling agent is preferably 0.1 parts by mass to 10 parts by mass, more preferably 0.2 parts by mass to 5 parts by mass relative to 100 parts by mass of the binder resin. When the amount thereof is smaller than 0.1 parts by mass, the control of the charge by the charge controlling agent may not be achieved. When the amount thereof is greater than 10 parts by mass, the electrostatic propensity of the resulting toner is excessively large, and therefore an effect of the charge controlling agent is reduced and electrostatic force to a developing roller increases, which may reduce flowability of a developer, or reduce image density of images formed with the resulting toner.

<<External Additives>>

The external additives are appropriately selected from those known in the art depending on the intended purpose without any limitation, and examples thereof include silica particles, hydrophobic silica particles, fatty acid metal salt (e.g., zinc stearate, and aluminum stearate), metal oxide (e.g., titanium oxide, alumina, tin oxide, and antimony oxide), hydrophobic metal oxide particles, and fluoropolymer. Among them, hydrophobic silica particles, hydrophobic titanium oxide particles, and hydrophobic alumina particles are preferable.

Examples of the silica particles include: HDK H 2000, HDK H 2000/4, HDK H 2050EP, HVK21, and HDK H1303 (all manufactured by Hoechst AG); and R972, R974, RX200, RY200, R202, R805, and R812 (all manufactured by Nippon Aerosil Co., Ltd.). Examples of the titanium oxide particles include: P-25 (manufactured by Nippon Aerosil Co., Ltd.); STT-30, and STT-65C-S (both manufactured by Titan Kogyo, Ltd.); TAF-140 (manufactured by Fuji Titanium Industry Co., Ltd.); and MT-150W, MT-500B, MT-600B, and MT-150A (all manufactured by TAYCA CORPORATION). Examples of the hydrophobic titanium oxide particles include: T-805 (manufactured by Nippon Aerosil Co., Ltd.); STT-30A, and STT-65S-S (both manufactured by Titan Kogyo, Ltd.); TAF-500T, and TAF-1500T (both manufactured by Fuji Titanium Industry Co., Ltd.); MT-100S, and MT-100T (both manufactured by TAYCA CORPORATION); and IT-S (manufactured by ISHIHARA SANGYO KAISHA, LTD.).

In order to attain hydrophobic silica particles, hydrophobic titanium oxide particles, and hydrophobic alumina particles, hydrophilic particles (e.g., silica particles, titanium oxide particles, and alumina particles) are treated with a silane coupling agent such as methyltrimethoxy silane, methyltriethoxy silane, and octyltrimethoxy silane.

As for the external additive, silicone oil-treated inorganic particles, which have been treated with silicone oil, optionally with an application of heat, can be suitably used.

As for the silicone oil, usable are dimethyl silicone oil, methylphenyl silicone oil, chloroanilinephenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl or methacryl-modified silicone oil, and α-methylstyrene-modified silicone oil.

Examples of the inorganic particles include silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica, and titanium dioxide are particularly preferable.

An amount of the external additives is preferably 0.1% by mass to 5% by mass, more preferably 0.3% by mass to 3% by mass, relative to the toner.

The number average particle diameter of primary particles of the inorganic particles is preferably 100 nm or smaller, more preferably 3 nm to 70 nm. When the number average particle diameter thereof is smaller than 3 nm, the inorganic particles are embedded into the toner particles, and therefore the inorganic particles do not effectively function. When the number average particle diameter is greater than 100 nm, the inorganic particles may unevenly damage a surface of a latent electrostatic image bearing member, and hence not preferable.

As the external additive, the inorganic particles, hydrophobic inorganic particles and the like may be used in combination. The number average particle diameter of primary particles of hydrophobic particles is preferably 1 nm to 100 nm. Of these, it is preferred that the external additive contain two types of inorganic particles having the number average particle diameter of 5 nm to 70 nm. Further, it is preferred that the external additive contain two types of inorganic particles having the number average particle of hydrophobic-treated primary particles thereof being 20 nm or smaller, and one type of inorganic particles having the number average particle thereof of 30 nm or greater. Moreover, the external additive preferably has BET specific surface area of 20 $m^2/g$ to 500 $m^2/g$.

Examples of the surface treating agent for the external additive containing the oxide particles include: a silane-coupling agent (e.g., dialkyl dihalogenated silane, trialkyl halogenated silane, alkyl trihalogenated silane, and hexaalkyl disilazane), a sililation agent, a silane-coupling agent containing a fluoroalkyl group, an organic titanate-based coupling agent, an aluminum-based coupling agent, silicone oil, and silicone varnish.

As the external additive, resin particles can also be added. Examples of the resin particles include; polystyrene obtained by a soap-free emulsification polymerization, suspension polymerization, or dispersion polymerization; copolymer of methacrylic ester or acrylic ester; polymer particles obtained by polymerization condensation, such as silicone, benzoguanamine, and nylon; and polymer particles formed of a thermoset resin. Use of these resin particles in combination can reinforce the charging ability of the toner, reduces reverse charges of the toner, reducing background deposition. An amount of the resin particles for use is preferably 0.01% by mass to 5% by mass, more preferably 0.1% by mass to 2% by mass, relative to the toner.

<<Flow Improving Agent>>

The flow improving agent is an agent capable of performing surface treatment of the toner to increase hydrophobicity, and preventing degradations of flow properties and charging properties of the toner even in a high humidity environment. Examples of the flow improving agent include a silane-coupling agent, a sililation agent, a silane-coupling agent containing a fluoroalkyl group, an organic titanate-based coupling agent, an aluminum-based coupling agent, silicone oil, and modified silicone oil.

<<Cleaning Improving Agent>>

The cleaning improving agent is added to the toner for the purpose of removing the developer remained on a latent electrostatic image bearing member or intermediate transfer member after transferring. Examples of the cleaning improving agent include: fatty acid metal salt such as zinc stearate, calcium stearate, and stearic acid; and polymer particles produced by soap-free emulsification polymerization, such as polymethyl methacrylate particles, and polystyrene particles. The polymer particles are preferably those having a relatively narrow particle size distribution, and the polymer particles having the weight average particle diameter of 0.01 μm to 1 μm are preferably used.

<<Magnetic Material>>

The magnetic material is appropriately selected from those known in the art depending on the intended purpose without any limitation, and examples thereof include iron powder, magnetite, and ferrite. Among them, a white magnetic material is preferable in view of color tone.

[Properties of Toner]

In order to achieve both low temperature fixing ability and heat resistant storage stability of highly desirable level, and to achieve excellent hot offset resistance of the toner of the present invention, the toner satisfies: $45 \leq Ta \leq 70$, and $0.8 \leq Tb/Ta \leq 1.55$, where Ta (° C.) is the maximum peak temperature of heat of melting the toner measured by a differential scanning calorimeter, and Tb (° C.) is a softening point of the toner measured by an elevated flow tester. In addition, the toner preferably satisfies: $1.0\times10^3 \leq G'(Ta+20) \leq 5.0\times10^6$, and $1.0\times10^3 \leq G''(Ta+20) \leq 5.0\times10^6$, where G'(Ta+20) (Pa) is the storage elastic modulus of the toner at the temperature of (Ta+20)° C., and G"(Ta+20) (Pa) is the loss elastic modulus of the toner at the temperature of (Ta+20)° C.

The maximum peak temperature (Ta) of heat of melting the toner is appropriately selected depending on the intended purpose without any limitation, but it is preferably 45° C. to 70° C., more preferably 53° C. to 65° C., and even more preferably 58° C. to 62° C. When Ta is 45° C. to 70° C., the minimum heat resistance storage stability required for the toner can be secured, and the toner having low temperature fixing ability more excellent than that of the conventional toner can be attained. When Ta is lower than 45° C., the desirable low temperature fixing ability of the toner can be attained, but the heat resistant storage stability is insufficient. When Ta is higher than 70° C., the heat resistant storage stability is improved, but the low temperature fixing ability reduces.

The ratio (Tb/Ta) of the softening temperature (Tb) of the toner to the maximum peak temperature (Ta) of heat of melting the toner is appropriately selected depending on the intended purpose without any limitation, but it is preferably 0.8 to 1.55, more preferably 0.85 to 1.25, even more preferably 0.9 to 1.2, and particularly preferably 0.9 to 1.19. As the value of Tb is smaller, it is more preferable because a resulting toner has a characteristic that the resin sharply softens, and have both desirable low temperature fixing ability and heat resistant storage stability.

As for the viscoelastic properties of the toner, the storage elastic modulus G'(Ta+20) at the temperature of (Ta+20)° C. is preferably $1.0\times10^4$ Pa to $5.0\times10^6$ Pa in view of fixing strength and hot offset resistance, and more preferably $5.0\times10^4$ Pa to $5.0\times10^5$ Pa. Moreover, the loss elastic modulus G"(Ta+20) at the temperature of (Ta+20)° C. is preferably $1.0\times10^3$ Pa to $5.0\times10^6$ Pa in view of hot offset resistance, and more preferably $1.0\times10^4$ Pa to $5.0\times10^5$ Pa.

Further, the toner preferably satisfies: $0.05\leq[G''(Ta+30)/G''(Ta+70)]\leq50$, where G"(Ta+30) (Pa) is the loss elastic modulus of the toner at the temperature of (Ta+30)° C., and G"(Ta+70) (Pa) is the loss elastic modulus at the temperature of (Ta+70)° C. By designing the toner to fall into the aforementioned range, the change in the loss elastic modulus of the toner against the temperature becomes mild, so that the resulting toner has excellent hot offset resistance with maintaining low temperature fixing ability. The value of [G"(Ta+30)/G"(Ta+70)] is preferably 0.05 to 50, more preferably 0.1 to 40, and even more preferably 0.5 to 30.

The viscoelastic properties of the toner can be appropriately controlled by adjusting a mixing ratio of the crystalline resin and non-crystalline resin constituting the binder resin, molecular weight of each resin, or formulation of the monomer mixture.

[Production Method of Toner]

The electrophotographic toner of the present invention contains at least a crystalline resin, a non-crystalline resin, a colorant, and a releasing agent, in which the toner has a storage elastic modulus of $5.0\times10^4$ Pa to $5.0\times10^6$ Pa at 80° C., and a storage elastic modulus of $2.0\times10^2$ Pa to $2.0\times10^3$ Pa at 140° C., and the toner has a ratio (C)/((C)+(A)) of 0.10 or greater, where (C) is an integrated intensity of a diffraction spectrum derived from a crystalline structure, (A) is an integrated intensity of a diffraction spectrum derived from a non-crystalline structure, and the diffraction spectrum is a diffraction spectrum of the toner as measured by an X-ray diffraction spectrometer. The production method or material of the toner can be selected from any of methods and materials known in the art without any limitation, as long as the resulting toner satisfies the aforementioned conditions. Examples of the production method thereof include a kneading-pulverization method, and a method in which toner particles are granulated in an aqueous medium, so-called a chemical method. In the chemical method, it is possible to easily granulate particles of a crystalline resin, and to easily locate an organic-modified layered inorganic mineral to the areas adjacent to the surfaces of the toner particles, in case where the organic-modified layered inorganic mineral is contained as the aforementioned other components.

Examples of the chemical method where toner particles are granulated in an aqueous medium include: a suspension polymerization method, emulsification polymerization method, seed polymerization method, and dispersion polymerization method, all of which use a monomer as a starting material; a dissolution suspension method in which a resin or resin precursor is dissolved in an organic solvent, and the resulting solution is dispersed and/or emulsified in an aqueous medium; a phase-transfer emulsification method in which water is added to a solution containing a resin or resin precursor, and an appropriate emulsifying agent to proceed phase transfer; and an aggregation method in which resin particles formed in any of the aforementioned methods is dispersed in an aqueous medium, and aggregated by heating and fusing to granulate particles of the predetermined size. Among them, the toner obtained by the dissolution suspension method is preferable because of granulation ability of the crystalline resin (e.g., easiness in control of particle size distribution, and control of particle shape), or orientation of organic-modified layered inorganic mineral adjacent to surface layers of toner particles.

These production methods will be specifically explained hereinafter.

The kneading-pulverization method is a method for producing toner base particles, for example, by melt-kneading a toner composition containing at least a colorant, a binder resin and a releasing agent, pulverizing the resulting kneaded product, and classifying the pulverized particles to thereby produce base particles of the toner.

In the melt-kneading, materials of the toner composition are mixed, and the resulting mixture is placed in a melt-kneader to perform melt-kneading. As the melt-kneader, for example, a monoaxial or biaxial continuous kneader, or a batch-type kneader with a roll mill can be used. Preferable examples thereof include a twin screw extruder KTT manufactured by KOBE STEEL, LTD., an extruder TEM manufactured by TOSHIBA MACHINE CO., LTD., a twin screw extruder manufactured by ASADA WORKS CO., LTD., a twin screw extruder PCM manufactured by Ikegai Corp., and a cokneader manufactured by Buss. The melt-kneading is preferably performed under the appropriate conditions so as not to cause scission of molecular chains of the binder resin. Specifically, the temperature of the melt-kneading is adjusted under taking the softening point of the binder resin as consideration. When the temperature of the melt-kneading is very high compared to the softening point, the scission occurs significantly. When the temperature thereof is very low compared to the softening point, the dispersing may not be progressed.

In the pulverizing, the kneaded product obtained by the kneading is pulverized. In the pulverizing, it is preferred that the kneaded product be coarsely pulverized, followed by finely pulverized. For the pulverizing, a method in which the kneaded product is pulverized by making the kneaded product to crush into an impact plate in the jet stream, a method in which particles of the kneaded product are made crushed each other in the jet stream to thereby pulverize the kneaded product, or a method in which the kneaded product is pulverized in a narrow gap between a mechanically rotating rotor and a stator is preferably used.

The classifying is classifying the pulverized product obtained by the pulverizing into particles having the predetermined particle diameters. The classifying can be performed by removing the fine particles component, for example, by means of a cyclone, a decanter, or a centrifugal separator.

After the completion of the pulverizing and the classifying, the classified pulverized product is classified in an air stream by centrifugal force to thereby produce toner base particles having the predetermined particle diameters.

The chemical method is appropriately selected depending on the intended purpose without any limitation, but the preferable method thereof is a method for granulating toner base particles by dispersing and/or emulsifying, in an aqueous medium, a toner composition containing at least the binder resin, the colorant, and the releasing agent.

As for the toner of the present invention, preferred is a toner obtained by granulating toner particles by dispersing and/or emulsifying, in an aqueous medium, a toner composition containing at least the binder resin, the colorant, and the releasing agent.

As for the chemical method, moreover, preferred is a method containing: dissolving and/or dispersing, in an organic solvent, a toner composition containing the binder resin and/or the binder resin precursor, and the colorant and the releasing agent, to form an oil phase; dispersing and/or emulsifying the oil phase in an aqueous medium to granulate base particles of the toner.

As for the toner of the present invention, preferred is a toner obtained by dissolving and/or dispersing, in an organic solvent, a toner composition containing the binder resin and/or the binder resin precursor, and the colorant and the releasing agent, to form an oil phase; dispersing and/or emulsifying the oil phase in an aqueous medium to granulate base particles of the toner.

Since the crystalline resin excels in impact resistance, it is not suitable for use in a pulverization method in terms of energy efficiency, and in the toner using the crystalline resin, it is difficult to align the organic-modified layered inorganic mineral adjacent to the surfaces of the toner particles. On the other hand, particles can be easily granulated using the crystalline resin in the dissolution suspension method, or ester elongation method, and these methods are preferable, as the organic-modified layered inorganic mineral are uniformly aligned adjacent to surfaces of toner particles during the dispersing and/or emulsifying in the aqueous medium.

The method for producing the resin particles containing at least the binder resin is appropriately selected depending on the intended purpose without any restriction, and examples thereof include the following (a) to (h);

(a) In the case of a vinyl resin particles, a method for directly producing an aqueous dispersion liquid of resin particles by a polymerization reaction of a suspension polymerization method, emulsification polymerization method, seed polymerization method, or dispersion polymerization method, using a monomer as a starting material.

(b) In the case of a polyaddition or condensation resin such as a polyester resin, polyurethane resin, and epoxy resin, a method for producing an aqueous dispersion liquid of resin particles by dispersing a precursor (e.g. a monomer, and oligomer) or a solvent solution thereof in an aqueous medium in the presence of an appropriate dispersant, followed by curing the particles by heating or adding a curing agent.

(c) In the case of a polyaddition or condensation resin such as a polyester resin, polyurethane resin, and epoxy resin, a method in which after dissolving an appropriate emulsifying agent in a precursor (e.g., a monomer and oligomer) or a solvent solution thereof (preferably in form of a liquid, which may be one liquefied by heating), water is added thereto to perform phase transfer emulsification.

(d) A method in which a resin that has been prepared by a polymerization reaction (which may be any polymerization reaction selected from addition polymerization, ring-opening polymerization, polyaddition, addition condensation, and condensation polymerization) in advance is pulverized by means of a pulverizer of mechanical rotation system or jet system, followed by classification to obtain resin particles, and the resulting resin particles are dispersed in water in the presence of an appropriate dispersant.

(e) A method in which a resin that has been prepared by a polymerization reaction (which may be any polymerization reaction selected from addition polymerization, ring-opening polymerization, polyaddition, addition condensation, and condensation polymerization) in advance is dissolved in a solvent to prepare a resin solution, the resin solution is sprayed in form of mist to obtain resin particles, and the resulting resin particles are dispersed in water in the presence of an appropriate dispersant.

(f) A method in which a resin that has been prepared by a polymerization reaction (which may be any polymerization reaction selected from addition polymerization, ring-opening polymerization, polyaddition, addition condensation, and condensation polymerization) in advance is dissolved in a solvent to prepare a resin solution, resin particles are precipitated by adding a solvent to the resin solution or cooling the resin solution into which a solvent has been dissolved by heating, followed by removing the solvent to obtain resin particles, and the resulting resin particles are dispersed in water in the presence of an appropriate dispersant.

(g) A method in which a resin that has been prepared by a polymerization reaction (which may be any polymerization reaction selected from addition polymerization, ring-opening polymerization, polyaddition, addition condensation, and condensation polymerization) in advance is dissolved in a solvent to prepare a resin solution, the resulting resin solution is dispersed in an aqueous medium in the presence of an appropriate dispersant, and the solvent is removed therefrom by heating or reducing the pressure.

(h) A method in which a resin that has been prepared by a polymerization reaction (which may be any polymerization reaction selected from addition polymerization, ring-opening polymerization, polyaddition, addition condensation, and condensation polymerization) in advance is dissolved in a solvent to prepare a resin solution, an appropriate emulsifying agent is dissolved in the resulting resin solution, and water is added thereto to perform phase transfer emulsification.

For emulsifying and/or dispersing in an aqueous medium, a surfactant or a polymer protective colloid can be optionally used.

—Surfactant—

The surfactant is appropriately selected depending on the intended purpose without any limitation, and examples thereof include: anionic surfactants such as alkyl benzene sulfonic acid salts, α-olefin sulfonic acid salts and phosphoric acid esters; cationic surfactants, such as amine salts (e.g., alkyl amine salts, amino alcohol fatty acid derivatives, polyamine fatty acid derivatives and imidazoline), and quaternary ammonium salt (e.g., alkyltrimethylammonium salts, dialkyldimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi (aminoethyl)glycine, di(octylaminoethyl)glycine and N-alkyl-N,N-dimethylammonium betaine.

Moreover, use of a fluoroalkyl group-containing surfactant as the surfactant can improve the effect of the surfactant with a very small amount thereof. Examples of the fluoroalkyl group-containing surfactant include a fluoroalkyl group-containing anionic surfactant, and a fluoroalkyl group-containing cationic surfactant.

Examples of the fluoroalkyl group-containing anionic surfactant include C2-C10 fluoroalkyl carboxylic acid or a metal salt thereof, disodium perfluorooctane sulfonyl glutamate, sodium 3-[ω-fluoroalkyl(C6-C11)oxy)-1-alkyl(C3-C4) sulfonate, sodium 3-[ω-fluoroalkanoyl(C6-C8)-N-ethylamino-]-1-propanesulfonate, fluoroalkyl(C11-C20) carboxylic acid or a metal salt thereof, perfluoroalkylcarboxylic acid (C7-C13) or a metal salt thereof, perfluoroalkyl(C4-C12)sulfonate or a metal salt thereof, perfluorooctanesulfonic acid diethanol amide, N-propyl-N-(2-hydroxyethyl) perfluorooctanesulfone amide, perfluoroalkyl(C6-C10)

sulfoneamidepropyltrimethylammonium salt, a salt of perfluoroalkyl(C6-C10)-N-ethylsulfonylglycin and monoperfluoroalkyl(C6-C16) ethylphosphate.

Examples of the fluoroalkyl group-containing cationic surfactant include a fluoroalkyl group-containing aliphatic primary or secondary amine acid, aliphatic quaternary ammonium salt such as a perfluoroalkyl(C6 to C10)sulfonic amide propyltrimethyl ammonium salt, benzalkonium salt, benzetonium chloride, pyridinium salt and imidazolinium salt.

—Polymer Protective Colloid—

The polymer protective colloid is appropriately selected depending on the intended purpose without any limitation, and examples thereof include: acid, such as acrylic acid, methacrylic acid, α-cyanoacrylic acid, α-cyanomethacrylic acid, itaconic acid, crotonic acid, fumaric acid, maleic acid and maleic anhydride; (meth)acryl monomer containing a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloroaniline-2-hydroxypropyl acrylate, 3-chloroaniline-2-hydroxypropyl methacrylate, diethylene glycol monoacrylate, diethylene glycol monomethacrylate, glycerin monoacrylate, glycerin monomethacrylate, N-methylol acryl amide, and N-methylol methacryl amide; vinyl alcohol or ether with vinyl alcohol, such as vinyl methyl ether, vinyl ethyl ether, and vinyl propyl ether; ester of vinyl alcohol and a compound containing a carboxyl group, such as vinyl acetate, vinyl propionate, and vinyl butyrate; acryl amide, such as acryl amide, methacryl amide, diacetone acryl amide, and methylol compounds thereof; acid chloride, such as acrylic acid chloride, and methacrylic acid chloride; a homopolymer or copolymer containing a nitrogen atom or its heterocycle, such as vinyl pyridine, vinyl pyrrolidone, vinyl imidazole, and ethylene imine; polyoxyethylene, such as polyoxy ethylene, polyoxypropylene, polyoxy ethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester; and cellulose, such as methyl cellulose, hydroxyethyl cellulose, and hydroxypropyl cellulose.

—Organic Solvent—

As for the organic solvent used for dissolving and/or dispersing the toner composition containing the binder resin and/or binder resin precursor, colorant, and releasing agent, a volatile organic solvent having a boiling point of lower than 100° C. is preferable because it can be easily removed in the later step.

Examples of the organic solvent include toluene, xylene, benzene, carbon tetrachloride, methylene chloride, 1,2-dichloroaniline ethane, 1,1,2-trichloroaniline ethane, trichloroaniline ethylene, chloroanilineform, monochloroanilinebenzene, dichloroanilineethylidene, methyl acetate, ethyl acetate, methylethyl ketone, and methyl isobutyl ketone. These may be used alone, or in combination. Among them, the ester-based solvent such as methyl acetate, and ethyl acetate, the aromatic solvent such as toluene, and xylene, and the halogenated hydrocarbon such as methylene chloride, 1,2-dichloroanilineethane, chloroanilineform, and carbon tetrachloride are preferable.

The solid content of the oil phase, which is obtained by dissolving and/or dispersing the toner composition containing the binder resin or binder resin precursor, the colorant, and the releasing agent is preferably 40% by mass to 80% by mass. The excessively high solid content thereof causes difficulties in dissolving or dispersing, and increases the viscosity of the oil phase which is difficult to handle. The excessively low solid content thereof leads to a low yield of the toner.

The toner composition excluding the resin, such as the colorant, and the organic-modified layered inorganic mineral, and master batches thereof may be separately dissolved and/or dispersed in an organic solvent, and then mixed with the resin solution and/or dispersion.

—Aqueous Medium—

As for the aqueous medium, water may be used solely, or water may be used in combination with water-miscible solvent. Examples of the water-miscible solvent include alcohol (e.g., methanol, isopropanol, and ethylene glycol), dimethyl formamide, tetrahydrofuran, cellosolve (e.g., methyl cellosolve), and lower ketone (e.g., acetone, and methyl ethyl ketone).

An amount of the aqueous medium used to 100 parts by mass of the toner composition is appropriately selected depending on the intended purpose without any limitation, but it is typically 50 parts by mass to 2,000 parts by mass, preferably 100 parts by mass to 1,000 parts by mass. When the amount thereof is smaller than 50 parts by mass, the toner composition cannot be desirably dispersed, and therefore toner particles having the predetermined particle diameters cannot be attained. When the amount thereof is greater than 2,000 parts by mass, it is not economical.

Inorganic dispersant and/or organic resin particles may be dispersed in the aqueous medium in advance, which is preferable for giving a sharp particle distribution to the resulting toner, and giving dispersion stability.

Examples of the inorganic dispersant include tricalcium phosphate, calcium carbonate, titanium oxide, colloidal silica and hydroxyapatite.

As for the resin for forming the organic resin particles, any resin can be used as long as it is a resin capable of forming an aqueous dispersion, and the resin for forming the organic resin particles may be a thermoplastic resin or thermoset resin. Examples of the resin include a vinyl resin, a polyurethane resin, an epoxy resin, a polyester resin, a polyamide resin, a polyimide resin, a silicon resin, a phenol resin, a melamine resin, a urea resin, an aniline resin, an iomer resin, and a polycarbonate resin. These may be used alone, or in combination. Among them, a vinyl resin, a polyurethane resin, an epoxy resin, a polyester resin, and a combination of any of the preceding resins are preferable because an aqueous dispersion liquid of fine spherical resin particles can be easily obtained.

The method for emulsifying and/or dispersing in the aqueous medium is not particularly limited, and to which a conventional equipment, such as a low-speed shearing disperser, a high-speed shearing disperser, a friction disperser, a high-pressure jetting disperser and ultrasonic wave disperser, can be employed. Among them, the high-speed shearing disperser is preferable in view of miniaturizing size of particles. In use of the high-speed shearing disperser, the rotating speed is appropriately selected without any limitation, but it is typically 1,000 rpm to 30,000 rpm, preferably 5,000 rpm to 20,000 rpm. The temperature for dispersing is typically 0° C. to 150° C. (in a pressurized state), preferably 20° C. to 80° C.

In the case where the toner composition contains the binder resin precursor, the compound containing an active hydrogen group, which is necessary for an elongation and/or crosslink reaction of the binder resin precursor, may be mixed in an oil phase before dispersing the toner composition in an aqueous medium, or mixed in the aqueous medium.

In order to remove the organic solvent from the obtained emulsified dispersion liquid, a conventional method known in the art can be used, and for example, a method, in which the temperature of the entire system is gradually increased under normal pressure or reduced pressure, to completely evaporate and remove the organic solvent in the droplets, can be employed.

In the case where the aggregation method is used in the aqueous medium, the resin particle dispersion liquid, colorant dispersion liquid, and the organic-modified layered inorganic mineral dispersion liquid obtained in the aforementioned manner, and optionally a dispersion liquid of a releasing agent or the like are mixed and aggregated together to thereby granulate particles. The resin particle dispersion liquid may be solely used, or two or more resin particle dispersion liquids may be added. Further, the resin particle dispersion liquid may be added at once, or added few times stepwise. This can also be said to the other dispersion liquids.

In order to control the aggregation state, a method such as heating, adding a metal salt, and adjusting pH can be preferably used.

The metal salt is appropriately selected depending on the intended purpose without any limitation, and examples thereof include: a monovalent metal salt including salts of sodium and potassium; a bivalent metal salt including salts of calcium and magnesium; and a trivalent metal salt including a salt of aluminum.

Examples of an anion for constituting the aforementioned salt include chloride ion, bromide ion, iodide ion, carbonic ion, and sulfuric ion. Among them, magnesium chloride, aluminum chloride, a complex or multimer thereof are preferable.

Heating during or after the aggregating accelerates fusion between resin particles, which is preferable in terms of homogeneity of the toner. Further, the shapes of the toner particles, i.e., the shape of the toner, can be controlled by the heating. Generally, the shapes of the toner particles become closer to spherical shapes as heating continues.

For washing and drying of the base particles of the toner dispersed in the aqueous medium, conventional techniques can be used.

Specifically, after the solid-liquid separation is performed by a centrifugal separator, or a filter press, the resulting toner cake is again dispersed in ion-exchanged water having the normal temperature to about 40° C., optionally adjusting the pH thereof with acid or alkali, followed by again subjected to solid-liquid separation. This series of operations are repeated a few times to remove impurities or the surfactant, followed by drying by means of a flash dryer, circulation dryer, vacuum dryer, or vibration flash dryer, to thereby obtain toner particles. The fine particle component may be removed from the toner by centrifugal separation or the like during the aforementioned operations, or it may be optionally classified to have the desirable particle size distribution by means of a conventional classifying device after the drying.

The resulting dry toner particles may be mixed with other particles such as charge controlling agent fine particles and flow improving agent particles, and also a mechanical impact may be applied to the mixture for immobilization or fusion of other particles on the toner surface, to thereby prevent the other particles from dropping off from the surfaces of the obtained composite particles.

Specific examples of the method include a method in which an impact is applied to a mixture using a high-speed rotating blade, and a method in which an impact is applied by putting mixed particles into a high-speed air flow and accelerating the air speed such that the particles collide against one another or that the particles are crashed into a proper collision plate.

Examples of apparatuses used in these methods include ANGMILL (manufactured by Hosokawa Micron Corporation), an apparatus produced by modifying I-type mill (manufactured by Nippon Pneumatic Mfg. Co., Ltd.) so that the pulverizing air pressure thereof is decreased, a hybridization system (manufactured by Nara Machinery Co., Ltd.), a kryptron system (manufactured by Kawasaki Heavy Industries, Ltd.) and an automatic mortar.

Moreover, the toner of the present invention can also be produced by the particle production method as disclosed in JP-B No. 4531076, that is, a particle production method containing dissolving materials constituting a toner in a fluid or supercritical carbon dioxide, and then removing the fluid or supercritical carbon dioxide, to thereby obtain toner particles.

(Developer)

The developer of the present invention contains the toner, and may further contain appropriately selected other components, such as a carrier, if necessary.

The developer may be a one-component developer, or two-component developer, but is preferably a two-component developer for use in recent high-speed printers corresponded to the improved information processing speed, in view of a long service life.

In the case of the one-component developer using the toner, the diameters of the toner particles do not vary largely even when the toner is balanced, namely, the toner is supplied to the developer, and consumed by developing, the toner does not cause filming to a developing roller, nor fuse to a layer thickness regulating member such as a blade for thinning a thickness of a layer of the toner, and provides excellent and stable developing ability and image even when it is used (stirred)) in the developing unit over a long period of time.

In the case of the two-component developer using the toner, the diameters of the toner particles in the developer do not vary largely even when the toner is balanced, and the toner can provide excellent and stable developing ability even when the toner is stirred in the developing unit over a long period of time.

<Carrier>

The carrier is appropriately selected depending on the intended purpose without any limitation, but the carrier is preferably a carrier containing core particles, and a resin layer covering each core particle.

A material for the core particles is appropriately selected from those known in the art without any limitation, but it is preferably 50 emu/g to 90 emu/g manganese-strontium (Mn—Sr) material, or manganese-magnesium (Mn—Mg) material, and is preferably a hard magnetic material such as iron powder (100 emu/g or higher), and magnetite (75 emu/g to 120 emu/g) for securing sufficient image density. Moreover, the material is preferably a soft magnetic material such as a copper-zinc (Cu—Zn) (30 emu/g to 80 emu/g) material because the toner particles born in the form of brush reduces an impact by contact to a latent electrostatic image bearing member, which is advantageous for providing high image quality. These may be used alone, or in combination.

As for particle diameters of the core particles, the average particle diameter (weight average particle diameter D50) of the core particles is preferably 10 μm to 200 μm, more preferably 40 μm to 100 μM. When the average particle diameter (weight average particle diameter (D50)) is smaller than 10 μm, the proportion of fine particles in the distribution of carrier particle diameters increases, increasing fine particles, causing carrier scattering because of low magnetization per carrier particle. When the average particle diameter thereof is greater than 200 μm, the specific surface area reduces, which may cause toner scattering, causing reproducibility especially in a solid image portion in a full color printing containing many solid image portions.

A material of the resin layer is appropriately selected from resins known in the art depending on the intended purpose without any limitation, and examples thereof include an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, copolymer of vinylidene fluoride and acryl monomer, vinylidene fluoride-vinyl fluoride copolymer, fluoroterpolymer (fluoroter(multi)polymer) (e.g., terpolymer of tetrafluoroethylene, vinylidene fluoride, and non-fluoromonomer), and a silicone resin. These may be used alone, or in combination. Among them, a silicone resin is particularly preferable.

The silicone resin is appropriately selected from silicone resins commonly known in the art depending on the intended purpose without any limitation, and examples thereof include a straight silicone resin constituted of organosiloxane bonds; and a modified silicone resin, which is modified with an alkyd resin, a polyester resin, an epoxy resin, an acryl resin, or a urethane resin.

The silicone resin can be selected from commercial products. Examples of commercial products of the straight silicone resin include KR271, KR255, and KR152 manufactured by Shin-Etsu Chemical Co., Ltd.; and SR2400, SR2406, and SR2410 manufactured by Dow Corning Toray Co., Ltd.

As for the modified silicone resin, commercial products thereof can be used. Examples of the commercial products thereof include: KR206 (alkyd-modified), KR5208 (acryl-modified), ES1001N (epoxy-modified), and KR305 (urethane-modified) manufactured by Shin-Etsu Chemical Co., Ltd.; and SR2115 (epoxy-modified), SR2110 (alkyd-modified) manufactured by Dow Corning Toray Co., Ltd.

Note that, the silicone resin can be used along, but the silicone resin can also be used together with a component capable of performing a crosslink reaction, a component for adjusting charging value, or the like.

The resin layer optionally contains electric conductive powder, and examples thereof include metal powder, carbon black, titanium oxide, tin oxide, and zinc oxide. The average particle diameter of the electric conductive powder is preferably 1 μm or smaller. When the average particle diameter thereof is greater than 1 μm, it may be difficult to control electric resistance.

The resin layer can be formed, for example, by dissolving the silicone oil or the like in a solvent to prepare a coating solution, uniformly applying the coating solution to surfaces of core particles by a conventional coating method, and drying the coated solution, followed by baking. Examples of the coating method include dip coating, spray coating, and brush coating.

The solvent is appropriately selected depending on the intended purpose without any limitation, and examples thereof include toluene, xylene, methyl ethyl ketone, methyl isobutyl ketone, cellosolve, and butyl acetate.

Baking may employ an external heating system or an internal heating system, without any limitation. Examples thereof include a method using a fix electric furnace, a flow electric furnace, a rotary electric furnace, or a burner furnace, and a method using microwaves.

An amount of the resin layer in the carrier is preferably 0.01% by mass to 5.0% by mass. When the amount thereof is smaller than 0.01% by mass, a uniform resin layer may not be formed on a surface of a core material. When the amount thereof is greater than 5.0% by mass, a thickness of the resin layer becomes excessively thick so that a plurality of carrier particles may form into one particle, and therefore uniform carrier particles cannot be obtained.

In the case where the developer is a two-component developer, an amount of the carrier in the two-component developer is appropriately selected depending on the intended purpose without any limitation, and it is, for example, preferably 90% by mass to 98% by mass, more preferably 93% by mass to 97% by mass.

As for a blending ratio of the toner and the carrier in the two-component developer, typically, an amount of the toner is preferably 1 part by mass to 10.0 parts by mass relative to 100 parts by mass of the carrier.

(Image Forming Apparatus)

The image forming apparatus of the present invention contains at least a latent electrostatic image bearing member, a charging unit configured to charge a surface of the latent electrostatic image bearing member, an exposing unit configured to expose the charged surface of the latent electrostatic image bearing member to light to form a latent electrostatic image, a developing unit configured to develop the latent electrostatic image with a toner to form a visible image, a transferring unit configured to transfer the visible image to a recording medium, and a fixing unit configured to fix the transferred visible image on the recording medium, and the toner used in the developing unit is the toner of the present invention. Moreover, the image forming apparatus of the present invention may further contain appropriately selected other units, such as a cleaning unit, a diselectrification unit, a recycling unit, and a controlling unit, if necessary.

Note that, the charging unit and the exposing unit may be collectively referred to as a latent electrostatic image forming unit. The developing unit contains a magnetic field generating unit fixed inside thereof, and contains a developer bearing member capable of bearing the toner of the present invention and rotating.

<Latent Electrostatic Image Bearing Member>

The material, shape, structure, or size of the latent electrostatic image bearing member is appropriately selected depending on the intended purpose without any limitation. Examples of the shape thereof include a drum shape, a sheet shape, and an endless belt shape. As for the structure thereof, the latent electrostatic image bearing member may have a single layer structure or a multilayer structure. The size thereof can be appropriately selected depending on the size and specification of the image forming apparatus. Examples of the material thereof include: an inorganic photoconductor such as amorphous silicon, selenium, CdS, and ZnO; and an organic photoconductor (OPC) such as polysilane, and phthalopolymethine.

<Charging Unit>

The charging unit is a unit configured to charge a surface of the latent electrostatic image bearing member.

The charging unit is appropriately selected depending on the intended purpose without any limitation, provided that it is capable of applying voltage to a surface of the latent electrostatic image bearing member to thereby uniformly charge the surface of the latent electrostatic image bearing member. The charge unit is roughly classified into a (1) contact charging unit which charges by being in contact with latent electrostatic image bearing member, and a (2) non-contact charging unit which charges without being in contact with the latent electrostatic image bearing member.

Examples of the (1) contact charging unit include an electric conductive or semiconductive charging roller, a magnetic brush, a fur brush, a film, and a rubber blade. Among them, the charging roller can significantly reduce a generating amount of ozone compared to corona discharge, has excellent stability when the latent electrostatic image bearing member is used repeatedly, and is effective in prevention of image deterioration.

Examples of the (2) non-contact charging unit include: a non-contact charger or needle electrode device utilizing corona discharge, and a solid discharge element; and an electric conductive or semiconductive charging roller provided with only a slight space to the latent electrostatic image bearing member.

<Exposing Unit>

The exposing unit is a unit configured to expose the charged surface of the latent electrostatic image bearing member to light to form a latent electrostatic image.

The exposing unit is appropriately selected depending on the intended purpose without any limitation, provided that it is capable of exposing the surface of the latent electrostatic image bearing member, which has been charged by the charging unit, to imagewise light corresponding to an image to be formed. Examples of the exposing unit include various exposure devices, such as a reproduction optical exposure device, a rod-lens array exposure device, a laser optical exposure device, a liquid crystal shutter optical device, and an LED optical exposure device. Moreover, the developing unit may employ a back light system in which imagewise light is applied from the back side of the latent electrostatic image bearing member for exposing.

<Developing Unit>

The developing unit is a unit configured to develop the latent electrostatic image with a toner to form a visible image, where the toner is the toner of the present invention.

The developing unit is appropriately selected from those known in the art without any limitation, provided that it can develop using the toner. As for the developing unit, for example, a unit containing at least a developing unit housing the toner therein and capable of applying the toner to the latent electrostatic image in a contact or non-contact manner is preferable.

The developing unit may employ a dry developing system, or a wet developing system. The developing unit may be a developing unit for a single color, or a developing unit for multicolor. Preferable examples thereof include a developing device containing a stirrer for rubbing and stirring the toner to charge the toner, a magnetic field generating unit fixed inside the device, and a rotatable developer bearing member bearing a developer containing the toner on the surface thereof.

In the developing unit, for example, the toner and the carrier are mixed and stirred, by the friction of which the toner is charged. The charged toner is held on a surface of a rotatable magnet roller in the form of a brush to form a magnet brush. Since the magnet roller is located adjacent the latent electrostatic image bearing member, part of the toner constituting the magnet brush formed on the surface of the magnet roller is moved to the surface of the latent electrostatic image bearing member by electric suction force. As a result, the latent electrostatic image is developed with the toner to form a visible image on the surface of the latent electrostatic image bearing member.

Figure 2:
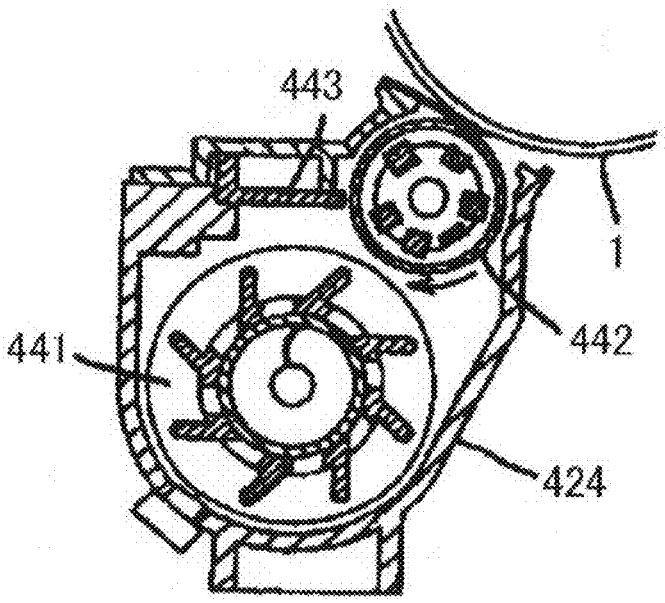
FIG. 2 is a schematic diagram illustrating one example of a two-component developing unit in the image forming apparatus of the present invention.

FIG. 2 is a schematic diagram illustrating one example of a two-component developing device using a two-component developer composed of a toner and a magnetic carrier. In the two-component developing device illustrated in FIG. 2, the two-component developer is stirred and conveyed by a screw 441, and then supplied to a developing sleeve 442 serving as a developer bearing member. The two-component developer supplied to the developing sleeve 442 is regulated by a doctor blade 443 serving as a layer thickness regulating member, and the amount of the developer to be supplied is controlled by a doctor gap, which is a space between the doctor blade 443 and the developer sleeve 442. When the doctor gap is too narrow, the amount of the developer is insufficient, causing insufficient in image density. When the doctor gap is too wide, conversely, an excessive amount of the developer is supplied to thereby cause a problem that the carrier deposition occurs on the photoconductor drum 1 serving as the latent electrostatic image bearing member. Accordingly, a magnet is provided inside the developing sleeve 442 as a magnetic field generating unit configured to form a magnetic field so that the developer forms brush around the circumferential surface of the magnetic sleeve. The developer forms a magnetic brush raised in the form of chains on the developer sleeve 442 along with the magnetic line of force in the direction of normal line emitted from the magnet.

The developer sleeve 442 and the photoconductor drum 1 are provided so as to be adjacent each other with a certain gap (i.e. developing gap), and a developing region is formed at the area where the both facing each other. The developing sleeve 442 is formed by forming a non-magnetic material (e.g. aluminum, brass, stainless steel, and an electric conductive resin) into a cylinder, and is driven to rotate by a rotation driving unit (not illustrated). The magnetic brush is transported to the developing region by the rotation of the developing sleeve 442. To the developing sleeve 442, developing voltage is applied from a power source for developing (not illustrated), and the toner on the magnetic brush is separated from the carrier by the developing electric field formed between the developing sleeve 442 and the photoconductor drum 1 serving as the latent electrostatic image bearing member, to develop the latent electrostatic image on the photoconductor drum 1. Note that, alternating current may be overlapped for the developing voltage.

The developing gap is preferably about 5 times to about 30 times the particle diameter of the developer. In the case where the particle diameter of the developer is 50 μm, the developing gap is preferably set to the range of 0.25 mm to 1.5 mm. When the developing gap is larger than the aforementioned range, desirable image density may not be attained.

The doctor gap is preferably the same to or slightly larger than the developing gap. The diameter and linear velocity of the photoconductor drum 1, and the diameter and linear velocity of the developing sleeve 442 are determined within restrictions such as the copying speed, or the size of the device. A ratio of the linear velocity of the drum to the linear velocity of the sleeve is preferably 1.1 or greater to attain sufficient image density. Note that, process conditions may be controlled by providing a sensor in a position downstream of the developing region, and detecting the deposition amount of the toner from the optical reflectance.

<Transferring Unit>

The transferring unit is a unit configured to transfer the visible image onto a recording medium.

The transferring unit is roughly classified into a transferring unit which directly transfer the visible image on the latent electrostatic image bearing member to a recording medium, and a secondary transferring unit, which uses an intermediate transfer member, and after primary transferring the visible image to the intermediate transfer member, secondary transfer the visible image to a recording medium. Whichever it is, the transferring unit is appropriately selected from transferring members known in the art depending on the intended purpose without any limitation.

<Fixing Unit>

The fixing unit is a unit configured to fix the transferred visible image on the recording medium.

The fixing unit is appropriately selected depending on the intended purpose without any limitation. As for the fixing unit, a fixing device containing a fixing member and a heat source for heating the fixing member is preferably used. The fixing member is appropriately selected depending on the intended purpose without any limitation, provided that it can form a nip in contact with another fixing member. Examples thereof include a combination of an endless belt and a roller, and a combination of a roller and a roller. Considering the reduced warm-up time, and energy saving, use of a combination of an endless belt and a roller, or a unit using a heating method where the fixing member is heated from its surface by induction heating is preferable.

The fixing unit is roughly classified into a (1) embodiment (internal heating system) where a fixing unit containing at least any of a roller or a belt, which is heated from the surface that is not in contact with the toner, and the transferred image on the recording medium is heated and pressurized to fix, and a (2) embodiment (external heating system) where a fixing unit contains at least any of a roller or a belt, which is heated from the surface that is in contact with the toner, and the transferred image on the recording medium is heated and pressurized to fix. Note that, it is possible to employ both of them in combination.

Examples of the (1) fixing unit of the internal heating system include a fixing unit containing a fixing member, where the fixing member contains a heating unit inside thereof. Examples thereof include a heat source such as a heater, and a halogen lamp.

Examples of the (2) fixing unit of the external heating system preferably include an embodiment where at least part of a surface of at least one fixing member out is heated by a heating unit. The heating unit is appropriately selected depending on the intended purpose without any limitation, and examples thereof include an electromagnetic induction heating unit. The electromagnetic induction heating unit is appropriately selected depending on the intended purpose without any limitation, but it is preferably the one containing a unit for generating a magnetic field, and a unit for generating heat by electromagnetic induction. As for the electromagnetic induction heating unit, for example, the one containing a induction coil provided adjacent to the fixing member (e.g., a heating roller), a shielding layer to which the induction coil is provided, and an insulating layer provided to a surface of the shielding layer opposite to the surface thereof where the induction coil is provided is suitably included. In this embodiment, the heating roller is preferably the one formed of a magnetic material, or the one that is a heat pipe. The conduction coil is provided to over at least a half the cylinder of the heating roller at the side which is opposite to the side of the heating roller where the heating roller is in contact with the fixing member (e.g., a pressurizing roller, and an endless belt).

(Process Cartridge)

The image forming apparatus of the present invention may be equipped with a process cartridge, which contains at least a latent electrostatic image bearing member and a developing unit, which are integratedly supported with appropriately selected optional other units, such as a charging unit, an exposing unit, a transferring unit, a cleaning unit, and a diselectrification unit, and is detachably mounted in a main body of the image forming apparatus.

The developing unit is a unit configured to develop a latent electrostatic image on the latent electrostatic image bearing member with a toner to form a visible image, where the toner is the toner of the present invention.

The developing unit contains at least a toner storage container housing the toner therein, and a toner bearing member configured to bear and convey the toner housed in the toner storage container, and may further contain a layer thickness regulating member for regulating a thickness of a toner layer born on the toner bearing member. The developing unit preferably contains at least a developer container housing the two-component developer, and a developer bearing member configured to bear and convey the two-component developer housed in the developer storage container. Specifically, the developing unit explained in the description of the image forming apparatus is suitably used.

As for the charging unit, exposing unit, transferring unit, cleaning unit, and diselectrification unit, those explained in the description of the image forming apparatus are appropriately selected and used.

The process cartridge can be detachably mounted in various electrophotographic image forming apparatuses, facsimiles, and printers, and is particularly preferably detachably mounted in the image forming apparatus of the present invention.

Figure 3:
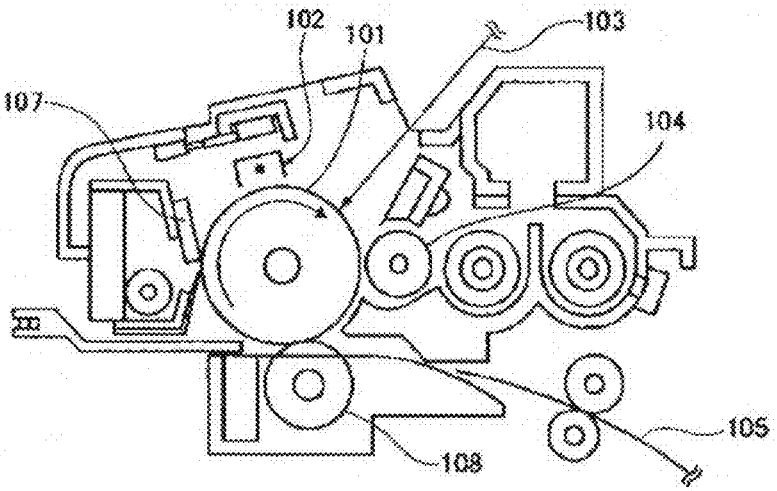
FIG. 3 is a schematic diagram illustrating one example of the process cartridge of the present invention.

The process cartridge is, for example as illustrated in FIG. 3, equipped therein with a latent electrostatic image bearing member 101, and contains a charging unit 102, a developing unit 104, a transferring unit 108, and a cleaning unit 107, and may further contain other units, if necessary. In FIG. 3, 103 denotes exposure light from the exposing unit, and 105 denotes a recording medium.

The image forming process in the process cartridge illustrated in FIG. 3 is described next. While rotating the latent electrostatic image bearing member 101 in the direction indicated with the arrow, a latent electrostatic image corresponding an exposure image is formed by a surface of the latent electrostatic image bearing member 101 as a result of charging by the charging unit 102, and exposing to light 103 by the exposing unit (not illustrated). The latent electrostatic image is developed with a toner by the developing unit 104 to form a toner image, and the developed toner image is transferred onto a recording medium 105 by the transferring unit 108, followed by output as a print. Next, a surface of the latent electrostatic image bearing member after the transferring is cleaned by the cleaning unit 107, diselectrified by the diselectrification unit (not illustrated), and again returned to the aforementioned operation.

EXAMPLES

The present invention will be more specifically explained through the following examples, but these examples shall not be construed as limiting the scope of the present invention.

<Ketimine Compound>

A reaction vessel equipped with a stirring bar and a thermometer was charged with 170 parts by mass of isophorone diamine, and 75 parts by mass of methyl ethyl ketone, and the resulting mixture was allowed to react for 5 hours at 50° C., to thereby obtain Ketimine Compound 1.

Ketimine Compound 1 had the amine value of 418.

<Crystalline Resin>

As a crystalline resin, Polyester Resin A1, Polyurethane Resin A2 and Polyurethane Resin A3 were produced as described below.

(Production of Polyester Resin A1)

A reaction tank equipped with a cooling tube, a stirrer, and a nitrogen-inlet tube was charged with 202 parts by mass (1.00 mol) of sebacic acid, 15 parts by mass (0.10 mol) of adipic acid, 177 parts by mass (1.50 mol) of 1,6-hexanediol, and 0.5 parts by mass of tetrabutoxy titanate as a condensation catalyst, and the resulting mixture was allowed to react for 8 hours at 180° C. under a flow of nitrogen gas, with removing water as generated.

The resultant was then gradually heated up to 220° C., and was allowed to react for 4 hours under a flow of nitrogen gas with removing the generated water and 1,6-hexanediol. The resultant was allowed to further react under the reduced pressure of 5 mmHg to 20 mmHg until Mw of the resultant reached about 12,000, to thereby obtain Polyester Resin A'1. Polyester Resin A'1 had Mw of 12,000.

Subsequently, Polyester Resin A'1 was transferred into a reaction vessel equipped with a cooling tube, a stirrer, and a nitrogen-inlet tube. To this, 350 parts by mass of ethyl acetate, and 30 parts by mass (0.12 mol) of 4,4'-diphenylmethane diisocyanate (MDI) were added, and the resulting mixture was allowed to react for 5 hours at 80° C. under a flow of nitrogen gas. Next, ethyl acetate was removed under the reduced pressure, to thereby obtain Polyester Resin A1. Polyester Resin A1 had Mw of 22,000, and the melting point of 62° C.

(Production of Polyurethane Resin A2)

A reaction vessel equipped with a stirrer and a thermometer was charged with 45 parts by mass (0.50 mol) of 1,4-butanediol, 59 parts by mass (0.50 mol) of 1,6-hexanediol, and 200 parts by mass of methyl ethyl ketone (may be abbreviated as MEK, hereinafter). To this fluid mixture, 250 parts by mass (1.00 mol) of 4,4'-diphenylmethane diisocyanate (MDI) was added, and the resulting mixture was allowed to react for 5 hours at 80° C., followed by removing the solvent, to thereby obtain Polyurethane Resin A2.

Polyurethane Resin A2 had Mw of 20,000, and the melting point of 60° C.

(Production of Polyurethane Resin A3)

A reaction tank equipped with a cooling tube, a stirrer, and a nitrogen-inlet tube was charged with 126 parts by mass of 1,4-butanediol, 215 parts by mass of 1,6-hexanediol, and 100 parts by mass of methyl ethyl ketone (MEK), and the resulting mixture was stirred. Thereafter, to the reaction tank, 341 parts by mass of hexamethylene diixocyanate (HDI) was added, and the resulting mixture was allowed to react for 8 hours at 80° C. under a flow of nitrogen. Subsequently, MEK was removed under the reduced pressure, to thereby obtain Polyurethane Resin A3.

Polyurethane Resin A3 had Mw of 18,000, and the melting point of 59° C.

<Non-Crystalline Resin>

As a non-crystalline resin, Polyester Resin B1 to Polyester Resin B6 described below were produced.

(Polyester Resin B1)

A reaction vessel equipped with a cooling tube, a stirrer, and a nitrogen-inlet tube was charged with 3-methyl-1,5-pentanediol, isophthalic acid, adipic acid, and trimellitic anhydride together with titanium tetraisopropoxide (1,000 ppm relative to the resin component) in the manner that a molar ratio OH/COOH of hydroxyl groups to carboxyl groups was to be 1.5, a diol component was composed of 100 mol % of 3-methyl-1,5-pentanediol, a dicarboxylic acid component was composed of 40 mol % of isophthalic acid, and 60 mol % of adipic acid, and an amount of trimellitic anhydride in the entire monomers was to be 1 mol %. Thereafter, the resulting mixture was heated to 200° C. over about 4 hours, and then heated to 230° C. over 2 hours. The reaction was carried out until no more water was generated. Thereafter, the resultant was further allowed to react for 5 hours under the reduced pressure of 10 mmHg to 15 mmHg, to thereby obtain intermediate polyester. Next, a reaction vessel equipped with a cooling tube, a stirrer, and a nitrogen-inlet tube was charged with the intermediate polyester and isophorone diisocyanate at molar ratio (mole numbers of OH of intermediate polyester/mole numbers of NCO of isophorone diisocyanate) of 2.0. The resultant was diluted to 50% by mass with ethyl acetate, and then the resulting mixture was allowed to react for 5 hours at 200° C. to thereby obtain a prepolymer.

The obtained prepolymer was stirred in a reaction vessel equipped with a heating device, stirrer, and a nitrogen-inlet tube. With stirring the prepolymer, Ketimine Compound 1 was added to the prepolymer dropwise in an amount that the amount of the amine of Ketimine Compound 1 was equimolar to the amount of isocyanate of the prepolymer. After stirring for 10 hours at 45° C., an elongation product of the prepolymer was taken out. The obtained elongation product of the prepolymer was dried at 50° C. under the reduced pressure until the residual amount of ethyl acetate became 100 ppm or less, to thereby obtain Polyester Resin B1 (non-crystalline polyester resin). Polyester Resin B1 had the molecular weight Mw of 150,000, and the glass transition temperature Tg of −40° C.

(Polyester Resin B2 to B5)

Polyester Resin B2 (a non-crystalline polyester resin) was synthesized in the same manner as in the synthesis of Polyester Resin B1, provided that the diol component was 100 mol % of 3-methyl-1,5-pentanediol, and the dicarboxylic acid component was composed of 20 mol % of isophthalic acid, and 80 mol % of adipic acid.

Polyester Resin B3 (a non-crystalline polyester resin) was synthesized in the same manner as in the synthesis of Polyester Resin B1, provided that the diol component was 100 mol % of 3-methyl-1,5-pentanediol, and the dicarboxylic acid component was composed of 80 mol % of isophthalic acid, and 20 mol % of adipic acid.

Polyester Resin B4 (a non-crystalline polyester resin) was synthesized in the same manner as in the synthesis of Polyester Resin B1, provided that the diol component was 100 mol % of 3-methyl-1,5-pentanediol, and the dicarboxylic acid component was 100 mol % of decanedioic acid.

Polyester Resin B5 (a non-crystalline polyester resin) was synthesized in the same manner as in the synthesis of Polyester Resin B1, provided that the diol component was 100 mol % of 3-methyl-1,5-pentanediol, and the dicarboxylic acid component was 100 mol % of isophthalic acid.

Polyester Resin B2 had the molecular weight Mw of 100,000, and the glass transition temperature Tg of −55° C.

Polyester Resin B3 had the molecular weight Mw of 110,000, and the glass transition temperature Tg of −4° C.

Polyester Resin B4 had the molecular weight Mw of 100,000, and the glass transition temperature Tg of −65° C.

Polyester Resin B5 had the molecular weight Mw of 110,000, and the glass transition temperature Tg of 5° C.

(Production of Polyester Resin B6)

A four-necked flask equipped with a nitrogen-inlet tube, a condenser, a stirrer, and a thermocouple was charged with a bisphenol A ethylene oxide (2 mol) adduct, and a bisphenol A propylene oxide (3 mol) adduct at a molar ratio (bisphenol A ethylene oxide (2 mol) adduct/bisphenol A propylene oxide (3 mol) adduct) of 85/15, and isophthalic acid and adipic acid at a molar ratio (isophthalic acid/adipic acid) of 80/20, where a molar ratio OH/COOH of hydroxyl groups to carboxyl groups was 1.3. The resulting mixture was allowed to react together with 500 ppm of titanium tetraisopropoxide for 8 hours at 230° C. under the atmospheric pressure, followed by further reacting for 4 hours under the reduced pressure of 10 mmHg to 15 mmHg. Thereafter, trimellitic anhydride was added t the flask in an amount that the trimellitic anhydride was 1 mol % relative to the total resin component, and the resulting mixture was allowed to react for 3 hours at 180° C. under the atmospheric pressure, to thereby obtain Polyester Resin B6.

Polyester Resin B6 had Mw of 6,000, and the melting point of 50° C.

Example 1

Production of Colorant Master Batch P1

Polyester Resin A1 (100 parts by mass), 100 parts by mass of a cyan pigment (C.I. Pigment Blue 15:3), and 30 parts by mass of ion-exchanged water were sufficiently mixed, and kneaded by means of an open-roll kneader (KNEADEX, manufactured by Nippon Coke & Engineering Co., Ltd.). As for the kneading temperature, the kneading was initiated at 90° C., followed by gradually cooling to 50° C. In the manner as described, Colorant Master Batch P1, in which a ratio (mass ratio) of the resin to the pigment was 1/1, was produced.

—Production of Layered Inorganic Mineral Master Batch F1—

Binder Resin A1 (100 parts by mass), a montmorillonite compound modified with a quaternary ammonium salt including a benzyl group at least a part thereof (CLAYTONE APA, manufactured by Southern Clay Products Inc.) (100 parts by mass), and ion-exchanged water (50 parts by mass) were sufficiently mixed, and kneaded by means of an open-roll kneader (KNEADEX, manufactured by Nippon Coke & Engineering Co., Ltd.). As for the kneading temperature, the kneading was initiated at 90° C., followed by gradually cooling to 50° C. In the manner as described, Layered Inorganic Mineral Master Batch F1, in which a ratio (mass ratio) of the resin and the pigment was 1/1, was produced.

—Production of Wax Dispersion Liquid—

A reaction vessel equipped with a cooling tube, a thermometer, and a stirrer was charged with 20 parts by mass of paraffin wax (HNP-9 (melting point: 75° C.), manufactured by NIPPON SEIRO CO., LTD.), and 80 parts by mass of ethyl acetate, and the resulting mixture was heated to 78° C. to sufficiently dissolve the wax in the ethyl acetate, followed by cooling to 30° C. over the period of 1 hour with stirring. The resultant was then subjected to wet pulverization by means of ULTRA VISCOMILL (of AIMEX CO., Ltd.) under the following conditions: a liquid feed rate of 1.0 Kg/hr, disc circumferential velocity of 10 m/s, 0.5 mm-zirconia beads packed to 80% by volume, and 6 passes, to thereby obtain Wax Dispersion Liquid.

—Production of Toner 1—

A vessel equipped with a thermometer and a stirrer was charged with 37 parts by mass of Polyester Resin A1 and 37 parts by mass of ethyl acetate, and the resulting mixture was heated to the temperature equal to or higher than the melting point of the resin to sufficiently dissolve Polyester Resin A1. To this, 88 parts by mass of a 50% by mass Polyester Resin B1 ethyl acetate solution, 30 parts by mass of Wax Dispersion Liquid, 2 parts by mass of Layered Inorganic Mineral Master Batch F1, 12 parts by mass of Colorant Master Batch P1, and 47 parts by mass of ethyl acetate were added, and the resulting mixture was stirred by means of TK Homomixer (of Tokushu Kika Kogyo Co., Ltd.) at 50° C. and at 10,000 rpm to uniformly dissolve and disperse the contents, to thereby obtain Oil Phase 1. Note that, the temperature of Oil Phase 1 was kept at 50° C. in the vessel, and Oil Phase 1 was used within 5 hours from the production so as not to crystallize the contents.

Next, another vessel equipped with a stirrer and a thermometer was charged with 90 parts by mass of ion-exchanged water, 3 parts by mass of a 5% by mass polyoxyethylene lauryl ether nonionic surfactant (NL450, manufactured by Dai-ichi Kogyo Seiyaku Co., Ltd.) aqueous solution, and 10 parts by mass of ethyl acetate, and the resulting mixture was mixed and stirred at 40° C. to thereby produce an aqueous phase solution. To the aqueous phase solution, 50 parts by mass of Oil Phase 1 the temperature of which had been kept at 50° C. was added, the resulting mixture was mixed for 1 minute at 40° C. to 50° C. by means of TK Homomixer (of Tokushu Kika Kogyo Co., Ltd.) at 13,000 rpm, to thereby obtain Emulsified Slurry 1.

A vessel equipped with a stirrer and a thermometer was charged with Emulsified Slurry 1, and the solvent was removed from Emulsified Slurry 1 over the period of 6 hours at 60° C., to thereby obtain Slurry 1.

The obtained toner base particles in Slurry 1 (100 parts by mass) were subjected to filtration under the reduced pressure, followed by subjected to the following washing procedure.

(1): ion-exchanged water (100 parts) was added to the filtration cake, and the resulting mixture was mixed by TK Homomixer (at 6,000 rpm for 5 minutes), followed by filtering the mixture;

(2): a 10% by mass aqueous sodium hydroxide solution (100 parts by mass) was added to the filtration cake obtained in (1), and the resulting mixture was mixed by TK Homomixer (at 6,000 rpm for 10 minutes), followed by filtering the mixture under reduced pressure;

(3): a 10% by mass hydrochloric acid (100 parts by mass) was added to the filtration cake obtained in (2), and the resulting mixture was mixed by TK Homomixer (at 6,000 rpm for 5 minutes), followed by filtering the mixture; and (4): ion-exchanged water (300 parts) was added to the filtration cake obtained in (3), and the resulting mixture was mixed by TK Homomixer (at 6,000 rpm for 5 minutes), followed by filtering the mixture.

This series of operations were performed twice, to thereby obtain Filtration Cake 1.

Filtration Cake 1 was dried by means of an air-circulating drier for 48 hours at 45° C., followed by passed through a sieve having a mesh size of 75 μM, to thereby produce Toner Base Particles 1.

Next, 100 parts by mass of Toner Base Particles 1 were mixed with 1.0 part by mass of hydrophobic silica (HDK-2000, manufactured by Wacker Chemie AG) by means of HENSCHEL MIXER, to thereby obtain Toner 1 having the volume average particle diameter of 5.8 μm.

—Production of Carrier—

Carrier used in a two-component developer of the invention was produced in the following manner.

As for a core material, 5,000 parts by mass of Mn ferrite particles (the weight average particle diameter: 35 μm) were used. As for a coating material, a coating liquid, which had been prepared by dispersing 450 parts by mass of toluene, 450 parts by mass of a silicone resin SR2400 (of Dow Corning Toray Co., Ltd., nonvolatile content: 50% by mass), 10 parts by mass of aminosilane SH6020 (of Dow Corning Toray Co., Ltd.), and 10 parts by mass of carbon black for 10 minutes, was used. A coating device was charged with the core material and the coating liquid to thereby coat the core material with the coating liquid. The coating device was a device equipped with a rotatable bottom plate disk, and a stirring blade, which performed coating by forming swirling air flow in a flow bed of the core material and the coating liquid. The resulting coated product was baked in an electric furnace for 2 hours at 250° C., to thereby obtain Carrier A.

—Production of Two-Component Developer—

Toner 1 (7 parts by mass) was uniformly mixed with 100 parts by mass of Carrier A by means of TURBULA mixer (manufactured by Willy A. Bachofen AG) for 3 minutes at 48 rpm to thereby charge the toner, where the TURBULA mixer was a mixer a container of which was driven in rolling motions to perform stirring. In the present invention, a stainless steel container having an internal volume of 500 mL was charged with 200 g of Carrier A and 14 g of the toner to perform mixing.

The thus obtained two-component developer was loaded in a developing unit of an intermediate transfer system tandem image forming apparatus (Image Forming Apparatus A) employing a contact charging system, two-component developing system, secondary transferring system, blade cleaning system, and external heating roller fixing system to perform image formation. From the image formation, performances of the toner and developer were evaluated.

Image Forming Apparatus A used in the performance evaluation is specifically explained hereinafter.

—Image Forming Apparatus A—

Figure 4:
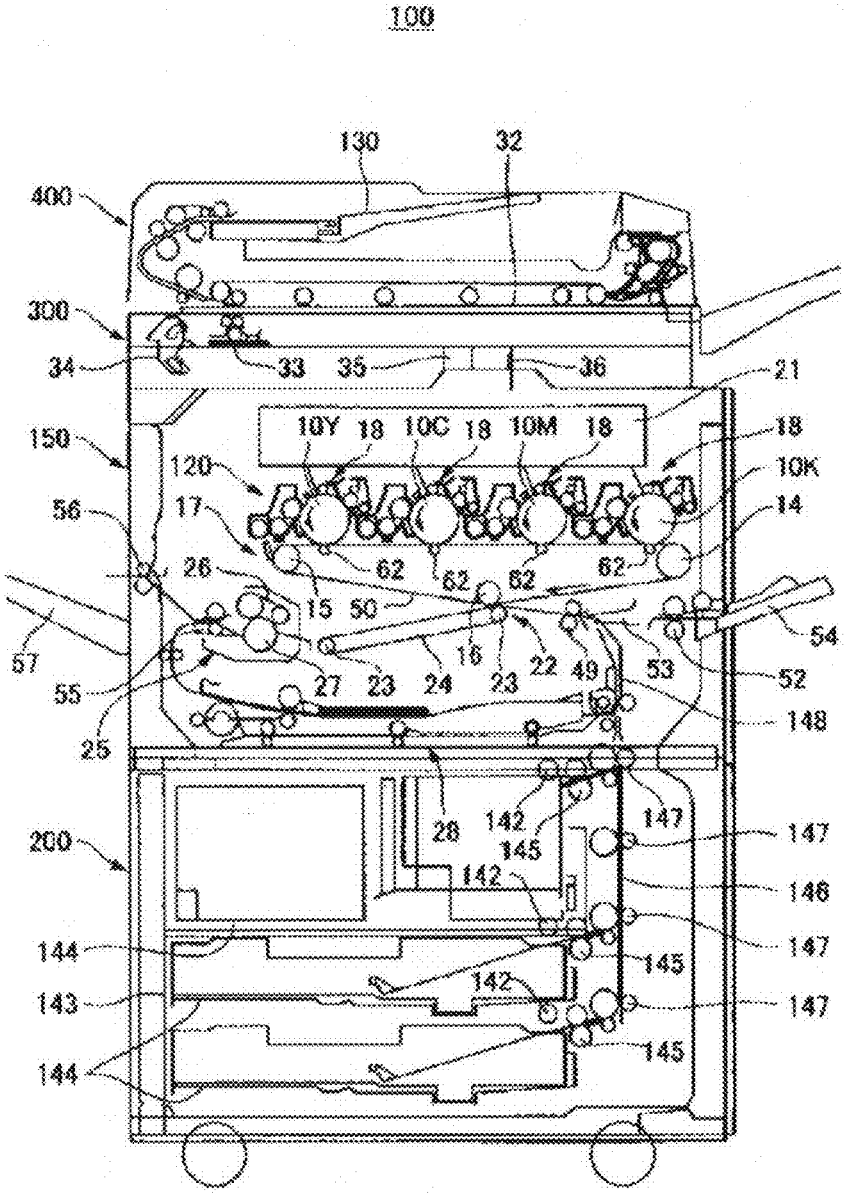
FIG. 4 is a schematic diagram illustrating one example of the image forming apparatus of the present invention.

Image Forming Apparatus A 100 illustrated in FIG. 4 is a tandem color image forming apparatus. Image Forming Apparatus A 100 is equipped with a photocopying device main body 150, feeding table 200, scanner 300, and automatic document feeder (ADF) 400.

To photocopying device main body 150, an intermediate transfer member 50 in the form of an endless belt is provided, and is mounted in the center of the main body 150. The intermediate transfer member 50 is rotatably supported by supporting rollers 14, 15 and 16 in the clockwise direction in FIG. 4. In the surrounding area of the supporting roller 15, an intermediate transfer member cleaning unit 17 configured to remove the residual toner on the intermediate transfer member 50 is provided. To the intermediate transfer member 50 supported by the supporting rollers 14 and 15, a tandem developing unit 120, in which four image forming units 18Y, 18C, 18M, 18K, respectively for yellow, cyan, magenta, and black, are aligned parallel to face the intermediate transfer member 50 along the conveying direction of the intermediate transfer member 50. An exposing unit 21 is provided adjacent to the tandem developing unit 120. A secondary transfer unit 22 is provided to the side of the intermediate transfer member 50, which is opposite to the side thereof where the tandem developing unit 120 is provided. In the secondary transfer member 22, a secondary transfer belt 24 in the form of an endless belt is supported by a pair of rollers 23, and is designed so that a recording medium conveyed on the secondary transfer belt 24 can be in contact with the intermediate transfer member 50. A fixing unit 25 is provided adjacent to the secondary transfer unit 22.

Note that, in Image Forming Apparatus A 100, a reversing device 28 is provided adjacent to the secondary transfer unit 22 and the fixing unit 25, where the reversing device 28 is configured to reverse a recording medium to perform image formation on both sides of the recording medium.

Next, formation of a full color image by means of the tandem developing unit 120 is explained.

Figure 5:
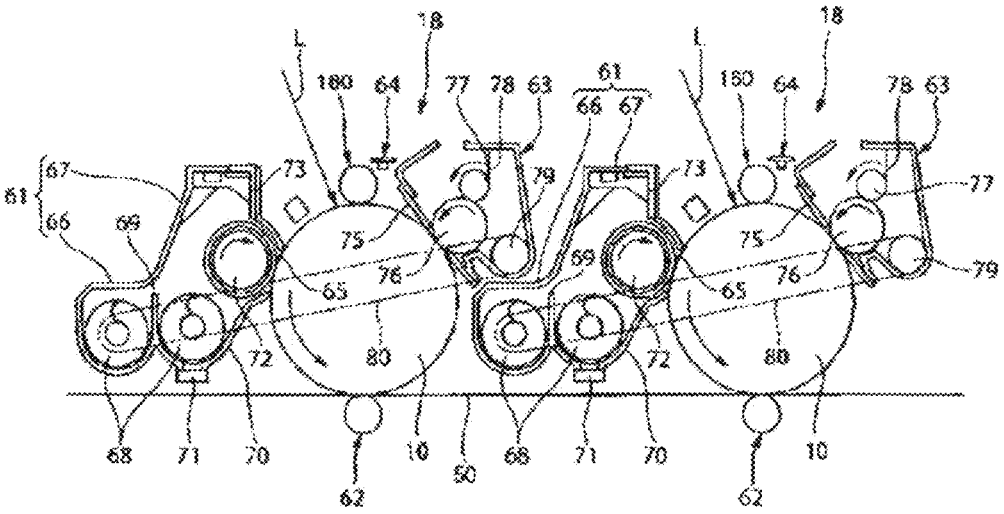
FIG. 5 is an enlarged schematic diagram illustrating one section of the image forming apparatus of FIG. 4.

Specifically, a document is, first, set on a document table 130 of the automatic document feeder (ADF) 400, or set on a contact glass 32 of a scanner 300 after opening the automatic document feeder 400, followed by closing the automatic document feeder 400. As a start switch (not illustrated) is pressed, in the case where the document is set in the automatic document feeder 400, the document is transported onto the contact glass 32, and then the scanner 300 is driven to scan a first scanning carriage 33 and a second scanning carriage 34. In the case where the document is set on the contact glass 32, the scanner 300 is driven immediately after the start switch is pressed. During this operation, as well as applying light from a light source of the first scanning carriage 33, the reflected light from the surface of the document is reflected by a mirror of the second scanning carriage 34. The reflected light is then passed through a imaging lens 35, and received by a reading sensor 36 to be read as a color document (color image), which constitutes image information of black, yellow, magenta and cyan. Each image information of black, yellow, magenta, or cyan is transmitted to a respective image forming unit 18 (black image forming unit 18K, yellow image forming unit 18Y, magenta image forming unit 18M, or cyan image forming unit 18C) of the tandem developing unit 120, and each toner image of black, yellow, magenta, or cyan is formed by the respective image forming unit. Specifically, each image forming unit 18 (black image forming unit 18K, yellow image forming unit 18Y, magenta image forming unit 18M, or cyan image forming unit 18C) in the tandem developing unit 120 is, as illustrated in FIG. 5, equipped with: a latent electrostatic image bearing member 10 (latent electrostatic image bearing member for black 10K, latent electrostatic image bearing member for yellow 10Y, latent electrostatic image bearing member for magenta 10M, or latent electrostatic image bearing member for cyan 10C); a charging unit 60 configured to uniformly charge the latent electrostatic image bearing member; an exposing unit configured to apply imagewise light (L in FIG. 5) to the respective latent electrostatic image bearing member corresponding to the respective color image information to form a latent electrostatic image corresponding to each color image on the latent electrostatic image bearing member; a developing unit 61 configured to develop the latent electrostatic image with each color toner (black toner, yellow toner, magenta toner, or cyan toner) to form a respective toner image; a transfer charger 62 for transferring the toner image to an intermediate transfer member 50; a cleaning unit 63; and a diselectrification unit 64, and each image forming unit 18 can form a respective monocolor image (black image, yellow image, magenta image, and cyan image) corresponding to the respective color image information. The black image, yellow image, magenta image and cyan image formed in the aforementioned manner are respectively transferred to the intermediate transfer member 50 rotatably supported by the supporting rollers 14, 15, and 16. Specifically, the black image formed on the latent electrostatic image bearing member for black 10K, the yellow image formed on the latent electrostatic image bearing member for yellow 10Y, the magenta image formed on the latent electrostatic image bearing member for magenta 10M, and the cyan image formed on the latent electrostatic image bearing member 10C are successively transferred (primary transferred) onto the intermediate transfer member 50. Then, the black image, yellow image, magenta image, and cyan image are superimposed on the intermediate transfer member 50 to thereby form a composite color image (color transfer image).

Meanwhile, in the feeding table 200, recording media is sent out from one of feeding cassettes 144 multiply equipped in a paper bank 143, by selectively rotating one of the feeding rollers 142, and the recording media is separated one by one with a separation roller 145 to send into a feeding path 146. The separated recording medium is then transported by the transporting roller 147 to guide into the feeding path 148 inside the photocopying device main body 150, and is bumped against the registration roller 49 to stop. Alternatively, the recording media on a manual-feeding tray 54 is ejected by rotating a feeding roller 142, separated one by one with a separation roller 52 to guide into a manual feeding path 53, and then stopped against the registration roller 49 in the similar manner. Note that, the registration roller 49 is generally earthed at the time of the use, but it may be biased for removing paper dust of the recording medium. The registration roller 49 is then rotated synchronously with the movement of the composite color image (color transfer image) formed on the intermediate transfer member 50, the recording medium is sent in between the intermediate transfer member 50 and a secondary transfer member 22, and the composite color image (color transfer image) is then transferred (secondary transferred) onto the recording medium by the secondary transfer unit 22, to thereby transfer and form the color image onto the recording medium. Note that, the residual toner on the intermediate transfer member 50 after the transferring of image is cleaned by an intermediate transfer member cleaning unit 17.

The recording medium on which the color image has been transferred and formed is transported by the secondary transfer member 22 to send to a fixing unit 25, and the composite color image (color transfer image) is fixed to the recording medium by heat and pressure applied by the fixing unit 25. Thereafter, the recording medium was changed its traveling direction by a switch craw 55, and ejected onto an output tray 57 by an ejecting roller 56. Alternatively, the recording medium is changed its traveling direction by the switch craw 55, reversed by the reversing device 28 to form an image on the back surface of the recording medium in the same manner as mentioned above, and then ejected onto the output tray 57 by the ejecting roller 56. Note that, in FIG. 4, the reference signs 26 and 27 respectively denote a fixing belt and a pressure roller.

A damage of an image by transporting due to recrystallization just after thermal fixing occurs in Image Forming Apparatus A 100 when a recording medium passes through a discharging roller 56 or transporting roller provided in the reversing device 28.

<Evaluation>

The details of the methods of the performance evaluations of the binder resin, toner, and developer of the present invention are explained hereinafter.

<<Melting Point Ta and Softening Point Tb of Binder Resin and Toner, and Ratio Ta/Tb of Melting Point to Softening Point>>

The melting points (the maximum peak temperature of heat of melting, Ta) of the binder resin and toner were measured by a differential scanning calorimeter (DSC)(TA-60WS and DSC-60, manufactured by Shimadzu Corporation). A sample provided for the measurement of the maximum peak of heat of melting was subjected to the pretreatment. As for the pretreatment, the sample was melted at 130° C., followed by cooling from 130° C. to 70° C. at the cooling rate of 1.0° C./min, the sample was then cooled from 70° C. to 10° C. at the cooling rate of 0.5° C./min. The sample was subjected to the measurement of endothermic and exothermic changes in DSC by heating at the heating rate of 20° C./min, to thereby plot "absorption or evolution heat capacity" verses "temperature" in a graph. The endothermic peak temperature in the range of 20° C. to 100° C. appeared in the graph was determined as "Ta*." Note that, in the case where there were few endothermic peaks, the temperature of the peak having the largest endothermic value was determined as Ta*. Thereafter, the sample was stored for 6 hours at the temperature of (Ta*−10)° C., followed by stored for 6 hours at the temperature of (Ta*-15)° C. Next, the sample was cooled to 0° C. at the cooling rate of 10° C./min, heated at the heating rate of 20° C./min to measure the endothermic and exothermic changes by means of DSC, creating a graph in the same manner as the above. In the graph, the temperature corresponding to the maximum peak of the absorption or evolution heat capacity was determined as the maximum peak temperature of heat of melting.

The softening points (Tb) of the binder resins and the toners were measured by means of an elevated flow tester (e.g., CFT-500D, manufactured by Shimadzu Corporation). As a sample, 1 g of the resin was heated at the heating rate of 6° C./min, and at the same time, load of 1.96 MPa was applied by a plunger to extrude the sample from a nozzle having a diameter of 1 mm and length of 1 mm, during which an amount of the plunger of the flow tester pushed down relative to the temperature was plotted. The temperature at which half of the sample was flown out was determined as a softening point of the sample.

<Measuring Method of Storage Elastic Modulus of Toner>

The storage elastic modulus of the toner was measured by means of a dynamic viscoelastometer (ARES, manufactured by TA Instruments Japan Inc.). The frequency used for the measurement was 1 Hz.

Specifically, a measuring sample was formed into a pellet having a diameter of 8 mm and a thickness of 1 mm to 2 mm, and the pellet sample was fixed to a parallel plate having a diameter of 8 mm, followed by stabilizing at 40° C. The sample was then heated to 200° C. at the heating rate of 2.0° C./min with frequency of 1 Hz (6.28 rad/s), and strain of 0.1% (in a strain control mode) to thereby measure dynamic viscoelastic values of the sample.

<<Integrated Intensity Ratio of Spectrum of Crystalline Structure and Non-Crystalline Structure>>

A ratio (C)/((C)+(A)) of each toner associated with the integrated intensity C of the part of the spectrum originated to the crystalline structure and the intensity ratio A of the part of the spectrum originated to the non-crystalline structure was determined in the aforementioned manner.

<<Low Temperature Fixing Ability (Minimum Fixing Temperature)>>

Using Image Forming Apparatus A, a solid image (the image size: 3 cm×8 cm) having a toner deposition amount of 0.85 $mg/cm^2$±0.1 $mg/cm^2$ (after transferring) on transfer paper (Copy Print Paper <70>, of Ricoh Business Expert, Ltd.) was formed, and the transferred image was fixed with varying the temperature of the fixing belt. The surface of the obtained fixed image was drawn with a ruby needle (point diameter: 260 μm to 320 μm, point angle: 60 degrees) by means of a drawing tester AD-401 (manufactured by Ueshima Seisakusho Co., Ltd.) with a load of 50 g. The drawn surface was rubbed 5 times with fibers (HaniCot #440, available from Sakata Inx Eng. Co., Ltd.). The temperature of the fixing belt at which hardly any image was scraped in the resulting image was determined as the minimum fixing temperature. Moreover, the solid image was formed in the position of the transfer paper, which was 3.0 cm from the edge of the paper from which the sheet was fed. Note that, the speed of the sheet passing the nip in the fixing device was 280 mm/s. The lower the minimum fixing temperature is, more excellent the low temperature fixing ability of the toner is.

[Evaluation Criteria]

The evaluation criteria of the low temperature fixing ability was set as follows, based on the minimum fixing temperature above.

A: lower than 110° C.

B: lower than 130° C., but 110° C. or higher

C: lower than 160° C., but 130° C. or higher

D: 160° C. or higher

<<Image Damage by Transportation>>

Using Image Forming Apparatus A, a solid image having a toner deposition amount of 0.85 mg/cm$^2$±0.1 mg/cm$^2$ (after transferring) was formed on the entire area of transfer paper (Type 6200, manufactured by Ricoh Company Limited), and the image was fixed with the fixing belt the temperature of which had been set at the temperature that was the minimum fixing temperature of the toner+10° C. A degree of damages on the surface of the obtained fixed image due to a discharging roller was evaluated comparing to the evaluation samples. Note that, the speed of the sheet passing the nip in the fixing device was 280 mm/s, and the A4-size sheet was fed from the wider side. The results are presented in Table 1.

[Evaluation Criteria]

The evaluation criteria of the image damage by transportation was set as follows.

A: hardly any transportation damage was observed

B: a transportation damage was slightly observed

C: a transportation damage was clearly observed

<<Heat Resistance Storage Stability>>

A 50 mL glass container was filled with the toner, and the container was left to stand in a thermostat of 50° C. for 24 hours, followed by cooling to 24° C. The resulting toner was subjected to a penetration degree test (JIS K2235-1991) to thereby measure a penetration degree (mm), and the result was evaluated in terms of the heat resistance storage stability based on the following criteria. The greater the penetration degree is, more excellent the heat resistance storage stability of the toner is. The toner having the penetration degree of lower than 5 mm is more likely to cause a problem on practice.

[Evaluation Criteria]

The evaluation criteria of the heat resistant storage stability was set as follows.

A: penetration degree of 25 mm or greater

B: penetration degree of 20 mm or greater, but less than 25 mm

C: penetration degree of 15 mm or greater, but less than 20 mm

D: penetration degree of 10 mm or greater, but less than 15 mm

E: penetration degree of less than 10 mm

Example 2

Production of Toner 2

Toner 2 was produced in the same manner as in Example 1, provided that Polyester Resin B1 was replaced with Polyester Resin B2. Toner 2 and a developer using Toner 2 were subjected to performance evaluations.

Example 3

Production of Toner 3

Toner 3 was produced in the same manner as in Example 1, provided that Polyester Resin B1 was replaced with Polyester Resin B3. Toner 3 and a developer using Toner 3 were subjected to performance evaluations.

Example 4

Production of Toner 4

Toner 4 was produced in the same manner as in Example 1, provided that Polyester Resin A1 was replaced with Polyurethane Resin A2. Toner 4 and a developer using Toner 4 were subjected to performance evaluations.

Example 5

Production of Toner 5

Toner 5 was produced in the same manner as in Example 1, provided that Polyester Resin A1 was replaced with Polyurethane Resin A2, and Polyester Resin B1 was replaced with Polyester Resin B2. Toner 5 and a developer using Toner 5 were subjected to performance evaluations.

Example 6

Production of Toner 6

Toner 6 was produced in the same manner as in Example 1, provided that Polyester Resin A1 was replaced with Polyurethane Resin A2, and Polyester Resin B1 was replaced with Polyester Resin B3. Toner 6 and a developer using Toner 6 were subjected to performance evaluations.

Example 7

Production of Toner 7

Toner 7 was produced in the same manner as in Example 1, provided that Polyester Resin A1 was replaced with Polyurethane Resin A3. Toner 7 and a developer using Toner 7 were subjected to performance evaluations.

Example 8

Production of Toner 8

Toner 8 was produced in the same manner as in Example 1, provided that Polyester Resin A1 was replaced with Polyurethane Resin A3, and Polyester Resin B1 was replaced with Polyester Resin B2. Toner 8 and a developer using Toner 8 were subjected to performance evaluations.

Example 9

Production of Toner 9

Toner 9 was produced in the same manner as in Example 1, provided that Polyester Resin A1 was replaced with Polyurethane Resin A3, and Polyester Resin B1 was replaced with Polyester Resin B3. Toner 9 and a developer using Toner 9 were subjected to performance evaluations.

Comparative Example 1

Production of Toner a

Toner a was produced in the same manner as in Example 1, provided that Polyester Resin B1 was replaced with Polyester Resin B4. Toner a and a developer using Toner a were subjected to performance evaluations.

Comparative Example 2

Production of Toner b

Toner b was produced in the same manner as in Example 1, provided that Polyester Resin B1 was replaced with Polyester Resin B5. Toner b and a developer using Toner b were subjected to performance evaluations.

Comparative Example 3

Production of Toner c

Toner c was produced in the same manner as in Example 1, provided that Polyester Resin A1 was replaced with Polyurethane Resin A2, and Polyester Resin B1 was replaced with Polyester Resin B4. Toner c and a developer using Toner c were subjected to performance evaluations.

Comparative Example 4

Production of Toner d

Toner d was produced in the same manner as in Example 1, provided that Polyester Resin A1 was replaced with Polyurethane Resin A2, and Polyester Resin B1 was replaced with Polyester Resin B5. Toner d and a developer using Toner d were subjected to performance evaluations.

Comparative Example 5

Production of Toner e

Toner e was produced in the same manner as in Example 1, provided that Polyester Resin A1 was replaced with Polyurethane Resin A3, and Polyester Resin B1 was replaced with Polyester Resin B4. Toner e and a developer using Toner e were subjected to performance evaluations.

Comparative Example 6

Production of Toner f

Toner f was produced in the same manner as in Example 1, provided that Polyester Resin A1 was replaced with Polyurethane Resin A3, and Polyester Resin B1 was replaced with Polyester Resin B5. Toner f and a developer using Toner f were subjected to performance evaluations.

Example 7

Production of Toner g

Toner g was produced in the same manner as in Example 1, provided that the amounts of Polyester Resin A1 and ethyl acetate were both changed from 37 parts by mass to 30 parts by mass, and the amount of 50% by mass Polyester Resin B1 ethyl acetate solution was changed from 88 parts by mass to 53 parts by mass. Toner g and a developer using Toner g were subjected to performance evaluations.

Comparative Example 8

Production of Toner h

Toner h was produced in the same manner as in Example 1, provided that Polyester Resin A1 was replaced with Polyester Resin B6. Toner h and a developer using Toner h were subjected to performance evaluations.

Comparative Example 9

Production of Toner i

Toner i was produced in the same manner as in Example 2, provided that Polyester Resin A1 was replaced with Polyester Resin B6. Toner i and a developer using Toner i were subjected to performance evaluations.

Comparative Example 10

Production of Toner j

Toner j was produced in the same manner as in Comparative Example 1, provided that 39 parts by mass of Polyester Resin A1 was replaced with 84 parts by mass of 50% by mass Polyester Resin B4 ethyl acetate solution. Toner j and a developer using Toner j were subjected to performance evaluations.

Comparative Example 11

Production of Toner k

Toner k was produced in the same manner as in Comparative Example 1, provided that the amounts of Polyester Resin A1 and ethyl acetate were both changed from 37 parts by mass to 47 parts by mass, and the amount of 50% by mass Polyester Resin B1 ethyl acetate solution was changed from 88 parts by mass to 41 parts by mass. Toner k and a developer using Toner k were subjected to performance evaluations.

The results of the performance evaluations of the toners and the developers are presented in Table 1.

TABLE 1

| | | Crystalline resin | | Non-crystalline resin | | |
|---|---|---|---|---|---|---|
| | | Resin | Melting point (° C.) | Resin | Tg (° C.) | (C)/((C) + (A)) |
| Ex. 1 | Toner 1 | A1 | 62 | B1 | −40 | 0.19 |
| Ex. 2 | Toner 2 | A1 | 62 | B2 | −55 | 0.21 |
| Ex. 3 | Toner 3 | A1 | 62 | B3 | −4 | 0.18 |
| Ex. 4 | Toner 4 | A2 | 60 | B1 | −40 | 0.20 |
| Ex. 5 | Toner 5 | A2 | 60 | B2 | −55 | 0.21 |
| Ex. 6 | Toner 6 | A2 | 60 | B3 | −4 | 0.19 |
| Ex. 7 | Toner 7 | A3 | 59 | B1 | −40 | 0.20 |
| Ex. 8 | Toner 8 | A3 | 59 | B2 | −55 | 0.21 |
| Ex. 9 | Toner 9 | A3 | 59 | B3 | −4 | 0.18 |
| Comp. Ex. 1 | Toner a | A1 | 62 | B4 | −65 | 0.22 |
| Comp. Ex. 2 | Toner b | A1 | 62 | B5 | 5 | 0.16 |
| Comp. Ex. 3 | Toner c | A2 | 60 | B4 | −65 | 0.22 |
| Comp. Ex. 4 | Toner d | A2 | 60 | B5 | 5 | 0.15 |
| Comp. Ex. 5 | Toner e | A3 | 59 | B4 | −65 | 0.23 |
| Comp. Ex. 6 | Toner f | A3 | 59 | B5 | 5 | 0.15 |
| Comp. Ex. 7 | Toner g | A1 | 62 | B1 | −40 | 0.12 |
| Comp. Ex. 8 | Toner h | A4 | 50 | B1 | −40 | 0.00 |
| Comp. Ex. 9 | Toner i | B6 | 50 | B2 | −55 | 0.00 |
| Comp. Ex. 10 | Toner j | A1 | 59 | B4 | −65 | 0.19 |
| Comp. Ex. 11 | Toner k | A1 | 62 | B1 | −40 | 0.25 |

TABLE 1-continued

| | | Evaluation item | | | | |
|---|---|---|---|---|---|---|
| | | Storage elastic modulus G' [Pa] | | Low temperature fixing | Image transport | Heat resistant storage |
| | | G'(80) | G'(140) | ability | damage | stability |
| Ex. 1 | Toner 1 | $2.5 \times 10^5$ | $3.8 \times 10^2$ | A | A | B |
| Ex. 2 | Toner 2 | $8.7 \times 10^4$ | $2.4 \times 10^2$ | A | B | B |
| Ex. 3 | Toner 3 | $5.0 \times 10^5$ | $5.8 \times 10^2$ | B | A | A |
| Ex. 4 | Toner 4 | $2.3 \times 10^5$ | $3.0 \times 10^2$ | A | A | B |
| Ex. 5 | Toner 5 | $8.4 \times 10^4$ | $2.2 \times 10^2$ | A | B | B |
| Ex. 6 | Toner 6 | $3.7 \times 10^5$ | $5.7 \times 10^2$ | B | A | B |
| Ex. 7 | Toner 7 | $2.2 \times 10^5$ | $2.7 \times 10^2$ | A | B | B |
| Ex. 8 | Toner 8 | $8.3 \times 10^4$ | $2.1 \times 10^2$ | A | B | B |
| Ex. 9 | Toner 9 | $3.2 \times 10^5$ | $5.5 \times 10^2$ | B | B | B |
| Comp. Ex. 1 | Toner a | $5.6 \times 10^4$ | $1.8 \times 10^2$ | A | C | D |
| Comp. Ex. 2 | Toner b | $8.2 \times 10^5$ | $2.2 \times 10^3$ | D | B | A |
| Comp. Ex. 3 | Toner c | $5.1 \times 10^4$ | $1.8 \times 10^2$ | B | C | D |
| Comp. Ex. 4 | Toner d | $8.1 \times 10^5$ | $2.2 \times 10^3$ | D | B | B |
| Comp. Ex. 5 | Toner e | $4.8 \times 10^4$ | $1.7 \times 10^2$ | B | C | D |
| Comp. Ex. 6 | Toner f | $8.0 \times 10^5$ | $2.1 \times 10^3$ | D | B | B |
| Comp. Ex. 7 | Toner g | $8.9 \times 10^3$ | $1.0 \times 10^2$ | A | B | D |
| Comp. Ex. 8 | Toner h | $3.2 \times 10^5$ | $2.5 \times 10^3$ | B | B | D |
| Comp. Ex. 9 | Toner i | $8.1 \times 10^4$ | $1.9 \times 10^2$ | A | B | D |
| Comp. Ex. 10 | Toner j | $4.9 \times 10^4$ | $2.3 \times 10^2$ | A | B | D |
| Comp. Ex. 11 | Toner k | $6.1 \times 10^5$ | $3.0 \times 10^2$ | B | C | B |

In Table 1-1, "G'(80)" denotes the storage elastic modulus at 80° C., and "G'(140)" denotes the storage elastic modulus at 140° C.

The embodiments of the present invention are, for example, as follows:

<1> An electrophotographic toner, containing:

a crystalline resin;

a non-crystalline resin;

a colorant; and a releasing agent, wherein the toner has a storage elastic modulus of $5.0\times10^4$ Pa to $5.0\times10^6$ Pa at 80° C., and a storage elastic modulus of $2.0\times10^2$ Pa to $2.0\times10^3$ Pa at 140° C., and wherein the toner has a ratio (C)/((C)+(A)) of 0.10 or greater, where (C) is an integrated intensity of a diffraction spectrum derived from a crystalline structure, (A) is an integrated intensity of a diffraction spectrum derived from a non-crystalline structure, and the diffraction spectrum is a diffraction spectrum of the toner as measured by an X-ray diffraction spectrometer.

<2> The electrophotographic toner according to <1>, wherein the non-crystalline resin has glass transition temperature of −60° C. or higher but lower than 0° C. as measured by a differential scanning calorimeter.

<3> The electrophotographic toner according to any of <1> or <2>, wherein the ratio (C)/((C)+(A)) is 0.15 or greater.

<4> The electrophotographic toner according to any one of <1> to <3>, wherein the crystalline resin is a resin containing a crystalline polyester unit.

<5> The electrophotographic toner according to any one of <1> to <4>, wherein the crystalline resin is a crystalline polyester resin, and the non-crystalline resin is a non-crystalline polyester resin.

<6> The electrophotographic toner according to any one of <1> to <5>, wherein the crystalline resin, or the non-crystalline resin, or both thereof are a resin containing a urethane bond, or a urea bond, or both thereof.

<7> The electrophotographic toner according to any one of <1> to <6>, wherein the crystalline resin is a copolymer containing a crystalline polyester unit and a polyurethane unit.

<8> The electrophotographic toner according to any one of <1> to <7>, wherein the toner contains toner particles, which are produced by a method containing:

dispersing or emulsifying a toner composition in an aqueous medium to granulate toner particles, where the toner composition contains a binder resin containing the crystalline resin and the non-crystalline resin, the colorant, and the releasing agent.

<9> The electrophotographic toner according to any one of <1> to <8>, wherein the non-crystalline resin is formed by elongating or crosslinking a modified resin containing an isocyanate group at a terminal thereof.

<10> A developer containing:

a carrier; and the toner according to any one of <1> to <9>.

<11> An image forming apparatus, containing:

a latent electrostatic image bearing member;

a charging unit configured to charge a surface of the latent electrostatic image bearing member;

an exposing unit configured to expose the charged surface of the latent electrostatic image bearing member to light to form a latent electrostatic image;

a developing unit configured to develop the latent electrostatic image with the toner according to any one of <1> to <9> to form a visible image;

a transferring unit configured to transfer the visible image to a recording medium; and a fixing unit configured to fix the transferred image, which has been transferred on the recording medium.

This application claims priority to Japanese application No. 2012-203850, filed on Sep. 18, 2012, and Japanese application No. 2013-018152, filed on Feb. 1, 2013, and incorporated herein by reference.

What is claimed is:

1. An electrophotographic toner, comprising:

a crystalline resin;

a non-crystalline resin;

a colorant; and a releasing agent, wherein the toner has a storage elastic modulus of $5.0\times10^4$ Pa to $5.0\times10^6$ Pa at 80° C., and a storage elastic modulus of $2.0\times10^2$ Pa to $2.0\times10^3$ Pa at 140° C., and wherein the toner has a ratio (C)/((C)+(A)) of 0.10 or greater, where (C) is an integrated intensity of a diffraction spectrum derived from a crystalline structure, (A) is an integrated intensity of a diffraction spectrum derived from a non-crystalline structure, and the diffraction spectrum is a diffraction spectrum of the toner as measured by an X-ray diffraction spectrometer, wherein the non-crystalline resin has glass transition temperature of −60° C. or higher but lower than 0° C. as measured by a differential scanning calorimeter.

2. The electrophotographic toner according to claim 1, wherein the ratio (C)/((C)+(A)) is 0.15 or greater.

3. The electrophotographic toner according to claim 1, wherein the crystalline resin is a resin containing a crystalline polyester unit.

4. The electrophotographic toner according to claim 1, wherein the crystalline resin is a crystalline polyester resin, and the non-crystalline resin is a non-crystalline polyester resin.

5. The electrophotographic toner according to claim 1, wherein the crystalline resin, or the non-crystalline resin, or both thereof are a resin containing a urethane bond, or a urea bond, or both thereof.

6. The electrophotographic toner according to claim 1, wherein the crystalline resin is a copolymer containing a crystalline polyester unit and a polyurethane unit.

7. The electrophotographic toner according to claim 1, wherein the toner contains toner particles, which are produced by a method containing:

dispersing or emulsifying a toner composition in an aqueous medium to granulate toner particles, where the toner composition contains a binder resin containing the crystalline resin and the non-crystalline resin, the colorant, and the releasing agent.

8. The electrophotographic toner according to claim 1, wherein the non-crystalline resin is formed by elongating or crosslinking a modified resin containing an isocyanate group at a terminal thereof.

9. A developer comprising:

a carrier; and a toner, wherein the toner contains:

a crystalline resin;

a non-crystalline resin;

a colorant; and a releasing agent, wherein the toner has a storage elastic modulus of $5.0\times10^4$ Pa to $5.0\times10^6$ Pa at 80° C., and a storage elastic modulus of $2.0\times10^2$ Pa to $2.0\times10^3$ Pa at 140° C., and wherein the toner has a ratio (C)/((C)+(A)) of 0.10 or greater, where (C) is an integrated intensity of a diffraction spectrum derived from a crystalline structure, (A) is an integrated intensity of a diffraction spectrum derived from a non-crystalline structure, and the diffraction spectrum is a diffraction spectrum of the toner as measured by an X-ray diffraction spectrometer, wherein the non-crystalline resin has glass transition temperature of −60° C. or higher but lower than 0° C. as measured by a differential scanning calorimeter.

10. The developer according to claim 9, wherein the ratio (C)/((C)+(A)) is 0.15 or greater.

11. The developer according to claim 9, wherein the crystalline resin is a resin containing a crystalline polyester unit.

12. The developer according to claim 9, wherein the crystalline resin is a crystalline polyester resin, and the non-crystalline resin is a non-crystalline polyester resin.

13. The developer according to claim 9, wherein the crystalline resin, or the non-crystalline resin, or both thereof are a resin containing a urethane bond, or a urea bond, or both thereof.

14. An image forming apparatus, comprising:

a latent electrostatic image bearing member;

a charging unit configured to charge a surface of the latent electrostatic image bearing member;

an exposing unit configured to expose the charged surface of the latent electrostatic image bearing member to light to form a latent electrostatic image;

a developing unit configured to develop the latent electrostatic image with a toner to form a visible image;

a transferring unit configured to transfer the visible image to a recording medium; and a fixing unit configured to fix the transferred image, which has been transferred on the recording medium, wherein the toner contains:

a crystalline resin;

a non-crystalline resin;

a colorant; and a releasing agent, wherein the toner has a storage elastic modulus of 5.0×104 Pa to 5.0×106 Pa at 80° C., and a storage elastic modulus of 2.0×102 Pa to 2.0×103 Pa at 140° C., and wherein the toner has a ratio (C)/((C)+(A)) of 0.10 or greater, where (C) is an integrated intensity of a diffraction spectrum derived from a crystalline structure, (A) is an integrated intensity of a diffraction spectrum derived from a non-crystalline structure, and the diffraction spectrum is a diffraction spectrum of the toner as measured by an X-ray diffraction spectrometer, wherein the non-crystalline resin has glass transition temperature of −60° C. or higher but lower than 0° C. as measured by a differential scanning calorimeter.

15. The image forming apparatus according to claim 14, wherein the ratio (C)/((C)+(A)) is 0.15 or greater.

16. The image forming apparatus according to claim 14, wherein the crystalline resin is a resin containing a crystalline polyester unit.

17. The image forming apparatus according to claim 14, wherein the crystalline resin, or the non-crystalline resin, or both thereof are a resin containing a urethane bond, or a urea bond, or both thereof.

* * * * *